US011286095B2

(12) United States Patent
Kloke et al.

(10) Patent No.: US 11,286,095 B2
(45) Date of Patent: Mar. 29, 2022

(54) SUPPORTING STRUCTURE FOR CONCURRENTLY SUPPORTING A PLURALITY OF CONTAINERS FOR SUBSTANCES FOR PHARMACEUTICAL, MEDICAL OR COSMETIC APPLICATIONS, TRANSPORT STRUCTURE AND TRANSPORT OR PACKAGING CONTAINER COMPRISING THE SAME

(71) Applicant: SCHOTT Schweiz AG, St. Gallen (CH)

(72) Inventors: Arne Kloke, St. Gallen (CH); Christian Komann, St. Gallen (CH)

(73) Assignee: SCHOTT SCHWEIZ AG, St. Gallen (CH)

( * ) Notice: Subject to any disclaimer, the term of this patent is extended or adjusted under 35 U.S.C. 154(b) by 47 days.

(21) Appl. No.: 15/880,122

(22) Filed: Jan. 25, 2018

(65) Prior Publication Data

US 2018/0208377 A1 Jul. 26, 2018

(30) Foreign Application Priority Data

Jan. 25, 2017 (DE) ..... 102017101398.9

(51) Int. Cl.
*B65D 71/70* (2006.01)
*A61J 1/16* (2006.01)
(Continued)

(52) U.S. Cl.
CPC ..... *B65D 71/70* (2013.01); *A61J 1/16* (2013.01); *A61J 7/0069* (2013.01); *B01L 9/06* (2013.01);
(Continued)

(58) Field of Classification Search
USPC ..... 206/364, 365, 366, 370, 443, 203, 438; 220/507, 518, 517, 516, 514; 211/74,
(Continued)

(56) References Cited

U.S. PATENT DOCUMENTS 2,970,715 A * 2/1961 Kappel ..... B65D 1/243 220/516
3,106,308 A * 10/1963 Julian ..... B65D 1/243 220/512

(Continued)

FOREIGN PATENT DOCUMENTS

CN 103359348 10/2013
DE 29511964 11/1995

(Continued)

*Primary Examiner* — Jacob K Ackun
(74) *Attorney, Agent, or Firm* — Ohlandt, Greeley, Ruggiero & Perle, L.L.P.

(57) ABSTRACT

The present disclosure relates to a supporting structure for concurrently supporting a plurality of containers for substances for pharmaceutical, medical or cosmetic applications, having a plurality of receptacles for accommodating the containers therein at least partially. Each of the receptacles has an open upper end for inserting the containers into the receptacles and a lower end having a retaining portion for delimiting an axial movement of the containers in the receptacles. Guiding portions are provided for guiding the containers into the receptacles during insertion. The guiding portions can have upper guiding and positioning portions close to the upper ends of the receptacles and lower guiding and positioning portions close to the lower ends of the receptacles, which are formed separately from each other and delimit a radial movement of the containers in the receptacles.

31 Claims, 31 Drawing Sheets

(51) Int. Cl.

| | |
|---|---|
| ***A61J 7/00*** | (2006.01) |
| ***B01L 9/06*** | (2006.01) |
| ***B65B 3/00*** | (2006.01) |
| ***B65D 1/36*** | (2006.01) |
| ***B65D 25/10*** | (2006.01) |
| *B65B 7/28* | (2006.01) |
| *B65B 21/18* | (2006.01) |
| *B65B 43/56* | (2006.01) |

(52) U.S. Cl.
CPC ..... *B65B 3/003* (2013.01); *B65D 1/36* (2013.01); *B65D 25/108* (2013.01); *B01L 2200/025* (2013.01); *B65B 7/2814* (2013.01); *B65B 21/18* (2013.01); *B65B 43/56* (2013.01)

(58) Field of Classification Search
USPC ..... 211/71.01
See application file for complete search history.

(56) References Cited

U.S. PATENT DOCUMENTS 3,375,934 A * 4/1968 Bates ..... B01L 9/06 211/72
3,416,694 A * 12/1968 Bebb ..... B65D 1/243 220/518
3,428,207 A * 2/1969 Schoeller ..... B65D 1/243 220/516
3,746,178 A * 7/1973 Wagschal ..... A47B 73/006 211/74
3,760,974 A * 9/1973 Oglesbee ..... A47G 23/0208 206/427
3,918,920 A * 11/1975 Barber ..... B01L 9/06 422/560
4,124,122 A * 11/1978 Emmitt ..... B01L 9/06 211/74
4,549,656 A * 10/1985 Barnes ..... B65D 81/022 206/443
4,785,578 A * 11/1988 Grene ..... A01G 9/029 47/86
5,655,673 A * 8/1997 Weterrings ..... A47B 81/00 211/74
5,996,818 A * 12/1999 Boje ..... B01L 9/06 206/443
6,123,205 A * 9/2000 Dumitrescu ..... B01L 9/06 206/443
7,122,158 B2 * 10/2006 Itoh ..... B01L 9/06 422/562
8,453,838 B2 * 6/2013 Hill ..... A61M 5/008 206/438
10,919,043 B2 * 2/2021 Johns ..... G01N 35/00732
2003/0217947 A1 * 11/2003 Ishikawa ..... B67C 3/24 206/583
2004/0195193 A1 10/2004 Jafari
2007/0090070 A1 * 4/2007 Langham ..... A61J 7/0069 211/74
2009/0242568 A1 * 10/2009 Apps ..... B65D 1/243 220/516
2009/0314675 A1 12/2009 Stahl
2012/0181285 A1 * 7/2012 Krauss ..... A61J 1/16 220/507
2013/0233815 A1 * 9/2013 Lesbirel ..... B65B 21/04 211/74
2014/0027332 A1 1/2014 Pawlowski
2015/0122693 A1 5/2015 Deutschle
2015/0144515 A1 * 5/2015 Chartres ..... A61B 1/015 206/370
2015/0166212 A1 6/2015 Wissner
2017/0136467 A1 * 5/2017 Johns ..... G01N 35/00732
2017/0183113 A1 6/2017 Deutschle
2018/0117594 A1 5/2018 Eberle
2018/0134423 A1 * 5/2018 Narvekar ..... A61M 5/008

FOREIGN PATENT DOCUMENTS

| | | |
|---|---|---|
| EP | 2448541 | 7/2013 |
| EP | 2740537 | 6/2014 |
| EP | 2848882 | 3/2015 |
| EP | 2868593 | 5/2015 |
| EP | 3136109 | 3/2017 |
| WO | 2014009037 | 1/2014 |
| WO | 2014072019 | 5/2014 |
| WO | 2016135051 | 9/2016 |
| WO | 2016166465 | 10/2016 |
| WO | 2016170161 | 10/2016 |

* cited by examiner

B-B

A-A

B-B

SUPPORTING STRUCTURE FOR CONCURRENTLY SUPPORTING A PLURALITY OF CONTAINERS FOR SUBSTANCES FOR PHARMACEUTICAL, MEDICAL OR COSMETIC APPLICATIONS, TRANSPORT STRUCTURE AND TRANSPORT OR PACKAGING CONTAINER COMPRISING THE SAME

CROSS-REFERENCE TO RELATED APPLICATION

The present application claims the benefit and priority of German Patent Application No. 10 2017 101 398.9, entitled "Supporting structure for concurrently supporting a plurality of containers for substances for pharmaceutical, medical or cosmetic applications, transport structure and transport or packaging container comprising the same", filed on Jan. 25, 2017, the whole content of which is hereby incorporated by reference.

BACKGROUND OF THE DISCLOSURE

1. Field of the Disclosure

The present disclosure relates to a supporting structure for concurrently supporting a plurality of containers for substances for pharmaceutical, medical or cosmetic applications and to a transport structure or a transport or packaging container comprising such a supporting structure and containers supported by it.

2. Discussion of the Related Art

As containers for the storage of medical, pharmaceutical or cosmetic preparations with liquid administration, particularly in pre-dosed quantities, drug containers such as vials, ampoules or cartridges are used on a large scale. These generally have a cylindrical shape or at least a cylindrical portion, can be made of plastic material or glass and are available in large quantities at low costs. In order to make filling of the containers under sterile conditions as economical as possible, these are increasingly delivered by the manufacturer of the containers to the pharmaceutical filling company in a sterile packaging, so that the pharmaceutical filling company does not need to clean and sterilize the containers. For this purpose, the containers need to be unpacked under sterile conditions at the pharmaceutical filling company, for example a pharmaceutical company, and then processed further. Increasingly, production concepts are also used wherein the containers remain in the supporting structure of the sterile packaging during the filling process and wherein the containers are filled while they are arranged in a supporting structure, which is part of the sterile packaging. In addition to the actual filling process, other sub-processes such as weighing, placing of stoppers, lyophilization and final sealing of the containers with the stoppers may also be carried out, while the containers are supported in the supporting structure. This results in numerous additional requirements on the supporting structure, especially with regard to the accuracy of the positions of the containers in the supporting structure.

CN 103359348-A discloses a supporting structure in the form of a tray, having a base on which a plurality of vertical positioning pins are provided between which the containers can be accommodated without mutual contact. The supporting structure is formed by injection molding from a plastic material. The vertical positioning pins also act as guiding portions for inserting the containers into the receptacles formed by the positioning pins.

WO 2016/135051 A1 discloses a further supporting structure, which is designed as a so-called nest and can be accommodated in a tub-shaped transport or packaging container (also known as a tube). On the underside of the supporting structure, a plurality of receptacles are formed, the bottoms of which are connected to each other, with vertical positioning pins protruding from the bottoms between which the containers can be accommodated without mutual contact. The vertical positioning pins also act as guiding portions for inserting the containers into the receptacles formed by the positioning pins.

EP 2448541 B1 discloses another supporting structure comprising tubular receptacles formed by side walls protruding perpendicularly from an upper side of the supporting structure. Further supporting structures are disclosed in the publications EP 2868593 A1, EP 2848882 A1, WO 2014/072019 A2 and EP 2740537 A1 of the Applicant.

U.S. Pat. Nos. 5,996,818 A and 4,124,122 A disclose a rack for test tubes. The test tubes are centered in hemispherical recesses at the bottom of the rack and are positioned using perforated plates which are arranged on two different levels. The perforated plates do not constitute guiding and positioning portions in the sense of the present application, because inserting the test tubes into the holes of the perforated plates requires very careful targeting. The rack is not formed in one piece.

EP 3136109 A1, which has been published after the date of priority of the present application, discloses individual cylindrical receptacles that are clipped into a holding rack. The receptacles have S-shaped spring-loaded clamping straps that hold the containers in place at the top and bottom of the receptacles. This supporting structure is not formed in one piece.

A further holding structure for cartridges is discloses in EP 2 448 541 B1. Upper guiding and positioning portions in the sense of the present application are not disclosed.

The insertion of the containers from above into the receptacles of the supporting structures always requires a very precise pre-positioning of the containers relative to the receptacles, which is a complex task.

Due to the production of the aforementioned supporting structures by injection molding or deep-drawing from a plastic material, the receptacles have certain deviations in their geometry, for example due to distortion, demolding bevels, roundness, concentricity, etc. These deviations result in a larger clearance between the containers and the supporting structure, which causes a greater freedom of movement for the containers in the receptacles. A subsequent post-processing in the tool is very complicated, so that certain deviations in the geometry cannot be avoided.

In particular, the demolding bevels lead to an increased tilting of the containers in the receptacles, which leads to difficulties for the automated filling process and in particular for stoppering, particularly with relatively long and slim containers, for example when stoppering cartridges.

Due to the ejection process during injection molding of the supporting structures, correspondingly large demolding bevels need to be provided at the pockets and receptacles of the supporting structures, which shrink on the cores of injection molds, wherein the inclination angle of the demolding bevels must be approx. 2°. Such large demolding bevels, however, cause a relatively inaccurate guidance and cause a lower packing density, particularly in the case of relatively long and slim containers such as cartridges. Relatively large minimum distances must therefore be maintained between the individual receptacles of the supporting structure, which limits the packing density that can be accomplished. The minimum distances may also be caused by mechanical measures for reinforcement of the supporting structure. However, such measures for reinforcement of the supporting structure usually result in a higher weight and in higher material costs for the supporting structure.

For different types of containers (e.g. vials, cartridges, syringe bodies) usually the same glass tube semi-finished products are used. If one divides the containers of different types into groups according to their common (tube) outer diameters, one will find out that these have different nest layouts and thus different packing densities of the supporting structures. Rather, for the aforementioned reasons the distances between the individual receptacles are usually different for a common (tube) outer diameter of the containers. This also increases the effort to automate treatment processes: for example, containers need to be positioned at different positions by means of grippers, robots or the like, in correspondence to the positions of the receptacles of a particular type of supporting structure.

SUMMARY OF THE DISCLOSURE

It is an object of the present disclosure to provide an enhanced supporting structure for concurrently supporting a plurality of containers for substances for pharmaceutical, medical or cosmetic applications that can be easily and cost-effectively manufactured, avoids a glass-to-glass contact between the containers held on the supporting structure in a simple manner, allows for high packing density and enables a precise positioning of the containers, wherein preferably a simple and reliable insertion of the containers into the receptacles of the supporting structure shall be possible. Further aspects of the present disclosure relate to transport structures or transport or packaging containers and to a sterile packaging structure comprising such a supporting structure.

According to aspects of the present disclosure as outlined hereinafter there are provided a supporting structure for concurrently supporting a plurality of containers for substances for pharmaceutical, medical or cosmetic applications, a transport structure consisting of a combination of such a supporting structure and of a plurality of containers for substances for pharmaceutical, medical or cosmetic applications held by it, a transport or packaging container comprising such a supporting structure, and a sterile packaging structure for the sterile transport of a plurality of containers for substances for pharmaceutical, medical or cosmetic applications.

According to the present disclosure, there is provided a supporting structure for concurrently supporting a plurality of containers for substances for pharmaceutical, medical or cosmetic applications, particularly vials or cartridges, comprising a plurality of receptacles for accommodating the containers therein at least partially or completely, so that the upper or lower ends of the containers protrude axially from the receptacles or do not protrude axially from the receptacles. Here, each of the receptacles comprises an open upper end for inserting the containers into the receptacles and a lower end having a retaining portion for delimiting an axial movement of the containers in the receptacles, i.e. for retaining the containers in axial direction in the receptacles. Furthermore, guiding portions are provided for guiding the containers into the receptacles during insertion.

According to the present disclosure, the guiding portions comprise upper guiding and positioning portions near the upper ends of the receptacles and lower guiding and positioning portions near the lower ends of the receptacles, wherein the upper guiding and positioning portions are formed separately from the lower guiding and positioning portions and are configured to delimit a radial movement of the containers in the receptacles. Here, the upper and lower guiding and positioning portions are formed in one piece with the supporting structure.

Since the upper and lower guiding and positioning portions are designed as independent portions that are separate from each other and are not directly connected to each other or even designed in one piece, according to the present disclosure a functional separation between the upper guiding and positioning portions and the lower guiding and positioning portions is made possible. Whereas conventionally the guiding and positioning portions are designed in one piece, especially in case of a production using an injection molding process, and need to be inclined over a relatively large distance in order to allow the supporting structure to be demolded from an injection mold at all, according to the present disclosure the upper and lower guiding and positioning portions can each be designed relatively short. Whereas conventionally this meant relatively large minimum distances between the receptacles, according to the present disclosure the upper and lower guiding and positioning portions can be designed relatively short, so that the minimum distances between the receptacles can be considerably reduced and the packing density that can be obtained can be increased considerably according to the disclosure. This advantage is particularly evident in supporting structures for supporting relatively long and slim pharmaceutical containers.

Another advantage of this functional separation is that according to the present disclosure the guidances and receptacles can be manufactured with very small tolerances. Since the outer diameter of the containers to be accommodated is given relatively precisely for production reasons, the freedom of movement and positional inaccuracy of the containers accommodated can be reduced to a minimum due to the precise design of the guidances and receptacles. The containers can thus be pre-positioned more precisely relative to the receptacles, which leads to less material abrasion and thus to fewer particles in the region of the supporting structure when the containers are inserted into the receptacles. This advantage also applies to the transport, because the containers can be accommodated in the receptacles with close fit and can therefore move less back and forth during transport.

Since the guiding and positioning portions according to the present disclosure do not need to extend over the entire length of the receptacles, material can also be saved during production, which makes a supporting structure according to the disclosure lighter and torsionally more stiff. Also the efforts required for production are reduced because simpler and more cost-effective molds can be used, in particular, for the production using plastic injection molding.

In principle, it can be sufficient if a single guiding and positioning portion is provided near the upper and lower end of a respective receptacle. Such a single guiding and positioning portion may also be provided with one or more protrusions extending radially inwards to adequately limit the radial movement of the containers, such protrusions being arranged at equal angular distances to each other along the circumference of the receptacles and preferably being arranged alternately near the upper and lower ends of the respective receptacles, if viewed in a plan view.

The restriction of the radial freedom of movement of the containers in the receptacles reduces the impact speed and thus the forces in case of a collision of the containers with the side walls or sidewall sections of the receptacles during transport. These reduced normal forces in turn result in smaller frictional forces and lower material abrasion (formation of particles) during storage of the containers in the receptacles, but also when they are inserted into the receptacles. Furthermore, the very precise guidance of the containers that is possible according to the present disclosure also enables a very precise removal of the containers from the receptacles, e.g. by lifting the containers by means of pre-positioned grippers. Guiding ribs designed in this manner also allow deviations in geometry, such as distortion, roundness, concentricity, etc., caused by the injection molding process used for the production of the supporting structure, to be precisely adapted and matched at a later stage.

The very precise positioning and guidance of the containers in the receptacles according to the present disclosure enables a higher packing density, especially for long, thin or slim containers, because a glass-to-glass contact between containers becomes less likely with increasing restriction of the freedom of movement. The stitch size can thus be narrowed.

Due to the greatly reduced freedom of movement of the containers in the receptacles, the required guide length can also be reduced. This is relevant, for example, in the case of long, thin or slim containers, such as cartridges or syringe cylinders, especially with small formats, because these can often only be guided into the receptacles up to the bottom half. Due to the very precise positioning and guidance of the containers according to the present disclosure, it can nevertheless be reliably ensured that there is no glass-to-glass contact. As a result, material can also be saved according to the present disclosure.

According to a preferred embodiment, there are no partitions between adjacent receptacles to prevent containers from colliding with adjacent receptacles, such as circumferential side walls that conventionally prevent containers in directly adjacent receptacles from colliding. Rather, this separation function can be completely eliminated due to the very precise positioning and centering according to the present disclosure by the upper and lower guiding and positioning portions. The radial support of the containers in the receptacles can therefore be provided exclusively by the upper and lower guiding and positioning portions. For this purpose, they are formed at sufficiently stable structures of the supporting structure, in particular at the edge of circular openings on the upper side of the supporting structure and at the lower ends of connecting webs protruding perpendicularly from the upper side of the supporting structure.

According to a further embodiment, the distance between the upper and lower guiding and positioning portions in the longitudinal direction of the receptacles is larger than the distance between the upper guiding and positioning portions and the upper ends of the receptacles and/or larger than the distance between the lower guiding and positioning portions and the lower ends of the receptacles. This distance basically corresponds to the axial length of the receptacle, while the guiding and positioning portions themselves are preferably arranged at relatively short distances to the upper and lower ends of the receptacles. For an optimum guide length, the upper guiding and positioning portions are preferably disposed at the level of an upper side of the supporting structure or at only a very small distance below the upper side, i.e. in a region where the supporting structure is most stable. In addition, the lower guiding and positioning portions are preferably located at the bottom of the receptacles for supporting the containers directly at the lower ends of the receptacles. In this manner, an undesired tilting of the containers in the receptacles can also be minimized, for example in the case of transport, which results in a further minimization of material abrasion due to friction of the containers on the side walls or retaining webs of the receptacles.

According to a further embodiment, due to their shape and dimensions the upper and lower guiding and positioning portions act as rigid or inflexible guiding and positioning portions for guiding and positioning the containers. The upper and lower guide and positioning portions are sufficiently wide and long to ensure that the upper and lower guide and positioning portions are not significantly deformed or buckled when the containers are guided. When guiding the containers, the upper and lower guide and positioning portions can only be slightly adjusted due to the general flexibility of the supporting structure itself, i.e. in particular due to the flexibility of the axial connecting webs and of the lower connecting webs, as described below.

According to a further embodiment, the upper and/or lower guiding and positioning portions protrude radially inwards into the receptacles, so that the cylindrical side walls of the receptacles are not radially supported by contact with side walls or retaining webs of the receptacles, but only a punctual contact with only a few guiding and positioning portions exists, which helps to further minimize material abrasion. The front ends of the upper and/or lower guiding and positioning portions of a respective receptacle together preferably enclose an upper and lower circle, respectively, which has a diameter that corresponds to the outer diameter of the containers to be accommodated in the respective region of the upper and lower guiding and positioning portions, respectively, or that is slightly larger than this outer diameter, for example larger by one or a few tenths of a millimeter, in order to minimize frictional forces and material abrasion. With greatly reduced freedom of movement of the containers in the receptacles, the required guide length of the guiding and positioning portions can also be reduced. This is relevant, for example, in the case of long, thin or slim containers, such as cartridges or syringe cylinders, especially with small formats, because often these can only be inserted into the receptacles up to the bottom half. Due to the very precise positioning and guidance of the containers according to the present disclosure, however, a collision of containers in adjacent receptacles can be reliably prevented. As a result, material can also be saved according to the present disclosure.

Here, the diameter of the above-mentioned upper and lower circle is preferably the same, which makes it even easier to demold the supporting structure from an injection mold and further minimizes an undesired tilting of the containers in the receptacles.

According to a further embodiment, the upper guiding and positioning portions of a receptacle are arranged at angles offset to the lower guiding and positioning portions of the receptacle, if viewed in a plan view, wherein the upper and lower guiding and positioning portions do not overlap. This offers considerable advantages, particularly in the production of the supporting structure by injection molding from a plastic material, because the supporting structure can be demolded in a single step from an injection mold, together with the upper and lower guiding and positioning portions. Because the upper and lower guiding and positioning portions are arranged at different angles and do not overlap, they do not interfere with each other during demolding.

According to a further embodiment, at least one upper and lower guiding and positioning portion and preferably a plurality of upper and lower guiding and positioning portions is assigned to each of the receptacles, which are arranged at constant angular distances to each other and distributed around the receptacles. This enables a symmetrical multi-point support of the containers in the receptacles. Preferably, the upper and lower guiding and positioning portions are arranged alternately, if viewed in a plan view, which makes the afore-mentioned demolding of the supporting structure even easier.

According to a further embodiment, the upper and lower guiding and positioning portions are designed as narrow upper and lower guiding ribs, respectively, which extend in the longitudinal direction of the receptacles and extend radially inwards into the receptacles. For this purpose, the front contact surfaces of the upper and lower guiding ribs may be wedge-shaped or rounded, which helps to further minimize the contact surface between the container and the respective guiding and positioning portion when the container is supported in the receptacle, thus further minimizing an undesired material abrasion on these contact surfaces.

According to a further embodiment, the front contact surfaces of the upper and/or lower guiding ribs are each provided with a wedge-shaped profile in the longitudinal direction or rounded off, enabling a precise positioning of the containers and a minimum material abrasion of the containers on the contact surfaces.

According to a further embodiment, the front contact surfaces of the upper and lower guiding ribs extend downwards at an acute angle of inclination relative to the longitudinal direction of the receptacles. The front surfaces of the guiding ribs may cause a further centering of the containers upon insertion perpendicularly from above the supporting structure. For this purpose, even small angles of inclination of these beveled front surfaces may be sufficient. For example, the angle of inclination of these beveled front surfaces may be in the range between 0° and 3°, more preferably in the range between 0.0° and 1.5°, and even more preferably in the range between 0.0° and 0.5°.

According to a further embodiment, the front contact surfaces of the upper and/or lower guiding ribs are each concavely curved in correspondence to the outer contour of the containers, so that a cylindrical side wall of the containers does not abut against the front contact surfaces of the upper and/or lower guiding ribs at punctual locations but with a linear contact region, whereby an even more precise positioning can be achieved.

According to a further embodiment, the front contact surfaces of the upper and/or lower guiding ribs are alternatively each formed convexly curved in order to contact the cylindrical side wall of the containers in an essentially point-shaped manner.

According to a further embodiment, the upper and/or lower guiding and positioning portions are each designed as ring segments extending in the longitudinal direction of the receptacles and projecting radially inwards into the receptacles, wherein a radius of curvature of the ring segments is matched to the outer diameter of the receptacles in order to contact the receptacles partially so that a cylindrical side wall of the receptacles respectively does not abut against the front contact surfaces of the upper and/or lower guiding ribs at punctual locations but with a linear contact region, whereby an even more precise positioning can be achieved.

According to a further embodiment, the upper guiding ribs are each designed in one piece with a circumferential peripheral web, which limits the upper end of a respective receptacle in radial direction. Here, the peripheral webs may be used to further reinforce the supporting structure, in particular an upper side of the supporting structure, in particular when they are formed completely circumferential around the edge of a respective receptacle and/or when they are directly or indirectly and permanently connected to each other via connecting webs or the like.

According to a further embodiment, the peripheral webs protrude essentially perpendicularly from an upper side of the supporting structure, wherein the peripheral webs are each provided with an insertion bevel. By means of the insertion bevels the containers can be guided even better upon insertion perpendicularly from above into the receptacles of the supporting structure, so that they can be inserted smoothly and without any major frictional or lateral forces into the receptacles. The insertion bevels act as a kind of catching funnel for catching the ends of the containers and guiding them in the direction of the upper guiding and positioning portions upon insertion perpendicularly from above into the receptacles of the supporting structure. For this purpose, the peripheral webs do not necessarily have to be formed as circumferential webs. Rather, it may be sufficient if several peripheral webs or guide structures are disposed at a distance from each other along the edge of a respective receptacle, wherein the distances between such peripheral webs or guide structures are smaller than the outer diameter of the containers. Thus, according to the present disclosure the containers need to be pre-positioned with less precision relative to the receptacles, which further reduces the effort involved in handling the containers. The containers can still be reliably inserted into the receptacles.

In general, the insertion bevels may start directly at the upper end of the peripheral webs in order to reduce the effective distance between the peripheral webs to the diameter between the upper guiding and positioning portions. In principle, however, the insertion bevels may also start only at a certain distance to the upper ends of the peripheral webs, so that the opening widths of the receptacles at the upper ends of the peripheral webs can then be maximum, in order to efficiently catch the containers upon insertion into the receptacles.

In general, the insertion bevels may also be concavely curved, but they are preferably formed as flat, inclined surfaces at the upper ends of the guiding ribs, which makes it considerably easier to remove or demold the supporting structure from an injection mold during production by injection molding. For this purpose, the insertion bevels may have a wedge-shaped profile, if viewed in the longitudinal direction of the receptacles.

According to a further embodiment, the peripheral webs are higher at intersection regions of adjacent peripheral webs than at central portions between two intersection regions, which further minimizes the use of material and the weight of the supporting structure. However, the containers can still be effectively caught at the highest portions of the peripheral webs, i.e. in the intersection regions, and can be efficiently guided perpendicularly from above into the receptacles of the supporting structure during insertion. Preference is given to this when the upper edges of the peripheral webs are continuously concave or, for example, triangular. Due to the lower height of the peripheral webs at the central portions, a locally adapted stiffness of the structure can also be accomplished, comparable to a simple bending beam in which a deflection can be reduced by reinforcing the material towards the center (corresponding to the region at the intersection regions) and thus an efficient reinforcement can be effected.

According to a further embodiment, additional axial connecting webs extend downwards from the central portions of the peripheral webs, which are connected to an underside of the supporting structure, in particular to provide additional support for the peripheral webs at the central portions. Due to this additional support, the central portions of the peripheral webs can also be sufficiently stiff despite their lower height and inherent rigidity. At the same time, the additional connection of the upper side with the underside via the additional axial connecting webs makes it possible to further reinforce the supporting structure.

According to a further embodiment, four peripheral webs or preferably six peripheral webs limit the upper ends of the receptacles in the radial direction. This automatically results in a four-fold or six-fold symmetry of the respective receptacles, which not only makes insertion of the containers into the receptacles easier, but also further increases the stiffness of the supporting structure, especially when the peripheral webs are connected to each other. The retaining portions that limit the axial movement of the containers in the receptacles may be provided on axial connecting webs which protrude perpendicularly from an upper side or from a base plane of the supporting structure and are connected to intersection regions of two or preferably of three peripheral webs each. The connecting webs are appropriately connected to the underside or bottom of the supporting structure, which further increases the stiffness of the supporting structure, in particular its torsional and flexural stiffness. Preferably, the lower guiding ribs are designed in one piece with these axial connecting webs.

If a further processing of the containers is envisaged while being accommodated in the receptacles of the supporting structure, the rigidity of these retaining protrusions may be considerable, so that, for example, stoppers can be pressed in via the filling openings of cartridges, while the cartridges are supported on the retaining protrusions at the ends opposite the filling openings, as described below.

According to a further embodiment, the lower ends of the afore-mentioned axial connecting webs form a circumferential side wall or are widened to form such a circumferential side wall of the receptacles, wherein the lower guiding ribs are each formed in one piece with the circumferential side wall formed by the lower ends of the axial connecting webs. The above-mentioned lower guiding ribs or lower guiding and positioning portions may be designed in particular in one piece with this circumferential sidewall at the lower ends of the axial connecting webs.

According to a further embodiment, the upper ends of the upper and/or lower guiding ribs are each provided with insertion bevels that extend inclined relative to the associated upper or lower guiding ribs. During insertion, the containers slide even more gently along the guiding ribs into the receptacles, which helps to further reduce material abrasion.

According to a further embodiment, the insertion bevels are inclined relative to the upper and/or lower guiding ribs at an angle in the range between 5° and 45°, more preferably in the range between 10° and 15° and even more preferably in the range between 12.5° and 14.5°. On the one hand, this allows an efficient catching of the containers during insertion perpendicular to the plane of the supporting structure and on the other hand, a reliable insertion into the receptacles formed by the guiding ribs underneath. Here, the transition region to the guiding ribs may be angled but also curved.

According to a further embodiment, the insertion bevels are inclined at a larger angle of inclination relative to the central axis of the receptacles than the guiding ribs. Since the angle of inclination of the guiding ribs relative to the central axis of the receptacles is negligible or at least very small, particularly in the range of about one degree only, the differential angle of inclination is essentially equal to the angle of inclination of the insertion bevels.

According to a further embodiment, the retaining portions are designed as retaining protrusions protruding radially inwards, wherein the retaining protrusions enclose respective openings at the lower ends of the receptacles. For this purpose, the retaining protrusions are preferably connected to each other by means of bottom webs in order to form circumferential bottom webs, each of which forming a passageway opening. In this manner, material and weight can be further reduced and yet a high stiffness of the underside or bottom of the supporting structure can be achieved. Furthermore, it is also possible to access the end of a container accommodated in the receptacle from the underside of the supporting structure. The shape of the openings is preferably adapted to the outer profile of the containers in this region and even more preferably this shape is circular, which further increases the stiffness of the underside or bottom of the supporting structure.

According to a further embodiment, the supporting structure is configured for supporting cartridges having a cylindrical base body and having an upper end with a narrowed neck portion and a shoulder portion adjoining it which merges into a cylindrical side wall of the containers. The opening width of the above-mentioned openings is matched to the upper ends of the cartridges in such a manner that the upper ends of the cartridges extend through the openings and that the shoulder portions of the cartridges are supported directly on the retaining protrusions or bottom webs in order to limit the axial displacement of the cartridges in the receptacles when the cartridges are accommodated upside down in the receptacles.

In general, the cartridges may also be designed as so-called double-chamber cartridges having a bypass protruding radially from a side wall of the cylindrical basic body.

The ejection openings of the cartridges may be closed with a stopper and sealed with a lid or cap, e.g. by means of a crimped metal lid, which still allows access to a septum in the stopper (pre-crimped cartridge). The opening widths of the above-mentioned openings at the lower ends of the receptacles may be dimensioned in such a manner that the front end of the cartridge with the stopper and the crimped-on metal lid can extend completely through this opening, so that the cartridges are supported on the retaining protrusions only in the region of the shoulder portion. The opening is preferably circular or formed in correspondence to the profile of the cartridge.

According to a further embodiment, an upper side or a base plane of the supporting structure is flat and, in particular, plate-shaped at least along the edge of the supporting structure, with the lower ends of the receptacles being connected to each other by webs which together span a plane. The supporting structure is thus built up quasi in a sandwich design and has a "perforated plate" at the upper side and bottom, which are basically formed as a single unit and which are connected to each other via the above-mentioned axial connecting webs in order to increase the stiffness of the upper side and bottom side. This design is particularly advantageous with regard to the area load generated by pharmaceutical containers already filled, such as vials or cartridges. This is because the higher axial load then causes the upper side of the supporting structure to be compressed, but that the bottom side of the supporting structure is stretched. The stiffer the upper side and bottom side are and the greater the distance between the upper side and the bottom side, the less the supporting structure bends under load.

According to a further embodiment, the edge of the supporting structure is additionally reinforced by a side wall that protrudes perpendicularly from the upper side of the supporting structure. Preferably this edge is formed in one piece with the upper side, especially with a T-shaped profile.

According to a preferred further embodiment, the supporting structure is designed as a nest for accommodating the plurality of containers, preferably a plurality of pharmaceutical containers, particularly of vials or cartridges.

According to a preferred further embodiment, the receptacles are connected to each other by means of connecting webs for further stiffening of the supporting structure, wherein the receptacles are designed in such a manner that two supporting structures of the same configuration can be stacked on top of each other in such a manner that the receptacles of an upper supporting structure are partially immersed in the receptacles of a supporting structure located underneath and that the connecting webs of an upper supporting structure are directly supported on an upper side or base plane of a supporting structure located underneath.

According to preferred further embodiment, the length of the receptacles is matched to the length of the containers in such a manner that the upper or lower ends of the containers protrude from the receptacles and are therefore freely accessible from above the supporting structure. This can be used for further processing or treatment of the containers, while they are accommodated in the receptacles and held on the supporting structure. For example, a nest may be temporarily held in a holding frame of a processing station, e.g. at a pharmaceutical filling company, while the substance is filled into the containers held on the supporting structure via the filling openings. Or, stoppers are pushed into the ends of the containers in order to close them, while the containers are held by the supporting structure. Or the ends protruding from the receptacles can be used to grip the containers and remove them from the receptacles.

According to a further embodiment, the supporting structure is formed in one piece by injection molding from a plastic material. The aforementioned inclined guiding ribs and/or insertion bevels can effectively support the demolding of the supporting structure from an injection mold.

According to another aspect of the present disclosure there is provided a transport structure for containers, consisting of a combination of the supporting structure as described above and of a plurality of containers for substances for pharmaceutical, medical or cosmetic applications held by it, the containers being accommodated in the receptacles of the supporting structure at least partially and retained in axial direction at the supporting structure, as described above.

According to another alternative embodiment, the supporting structure is designed as an accommodating member in which the plurality of receptacles is formed as truncated conical receptacles in a regular arrangement and in one piece, so that the containers can be accommodated in the receptacles with their upper ends directed towards the bottoms of the receptacles while preventing a direct contact of adjacent containers accommodated in the receptacles of the accommodating member. The accommodating member may serve as a holding tray for the containers and may also be sealed directly for sterile transport and storage of the containers, for example by means of a sealing film.

The receptacles are preferably matched to the lengths of the containers in such a manner that the containers are accommodated completely in the receptacles, i.e. that their ends do not protrude out of the receptacles.

According to a further embodiment, a supporting member is provided for covering the bottoms of the containers accommodated in the accommodating member, wherein the supporting member is formed by a base plate having a flat support surface facing the receptacles.

Here, the aforementioned accommodating member and the supporting member may be produced of a plastic material by injection molding.

According to another aspect of the present disclosure, a transport structure for containers is provided, consisting of a combination of the supporting structure as described above and a plurality of containers for substances for pharmaceutical, medical or cosmetic applications held by it, the containers being accommodated in the receptacles and retained in axial direction at the supporting structure.

According to another aspect of the present disclosure, there is provided a transport or packaging container for a plurality of containers for substances for pharmaceutical, medical or cosmetic applications, the transport or packaging container being box-shaped, wherein a supporting structure as described above is accommodated in the box-shaped transport or packaging container together with the containers held at it, in order to hold the plurality of containers in the transport or packaging container.

In particular, the transport or packaging container may be closed or sealed by means of a gas-permeable plastic film, in particular by means of a plastic film formed from a gas-permeable mesh of plastic fibers and in particular a Tyvek® film.

Furthermore, for a sterile transport and storage a sterile packaging structure may be provided, comprising at least one transport structure as described above or at least one transport or packaging container as described above and comprising the containers accommodated therein, wherein the at least one transport structure or the at least one transport or packaging container is accommodated in at least one sterile bag and sterilely packed against the environment. Here, the at least one sterile bag may comprise a gas-permeable portion formed in particular by a mesh of plastic fibers such as polypropylene fibers (PP).

BRIEF DESCRIPTION OF THE FIGURES

In the following, the disclosure will be described in an exemplary manner with reference to the enclosed drawings, from which further features, advantages and problems to be solved will become apparent. In the drawings.

In the drawings, identical reference numerals designate identical or technically equivalent elements or groups of elements.

DETAILED DESCRIPTION OF THE DISCLOSURE

Figure 1A:
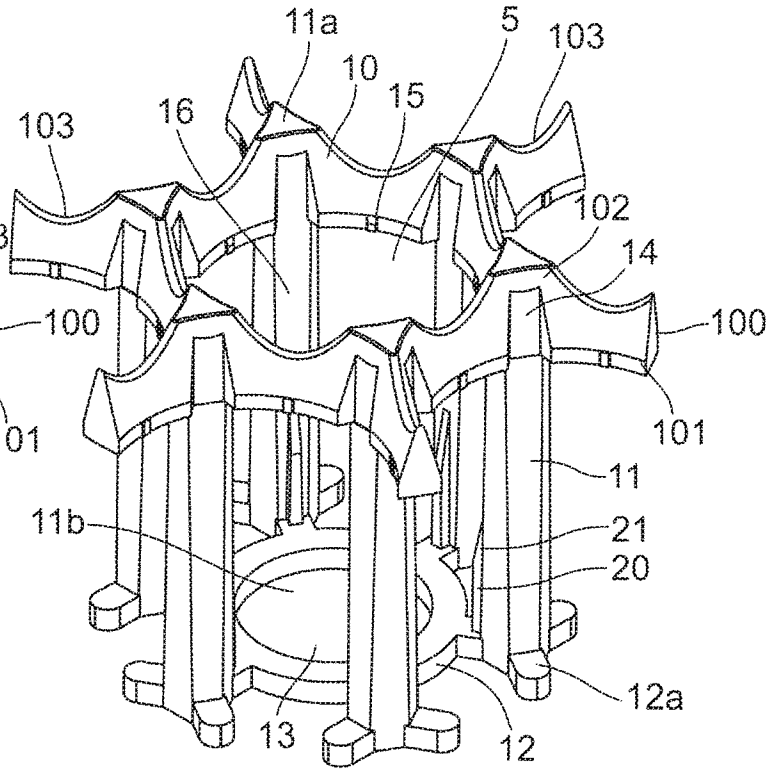
FIGS. 1*a* and 1*b* show a base unit of a supporting structure according to a first embodiment of the present disclosure in a perspective view, namely without containers and with containers held therein.
Figure 1B:
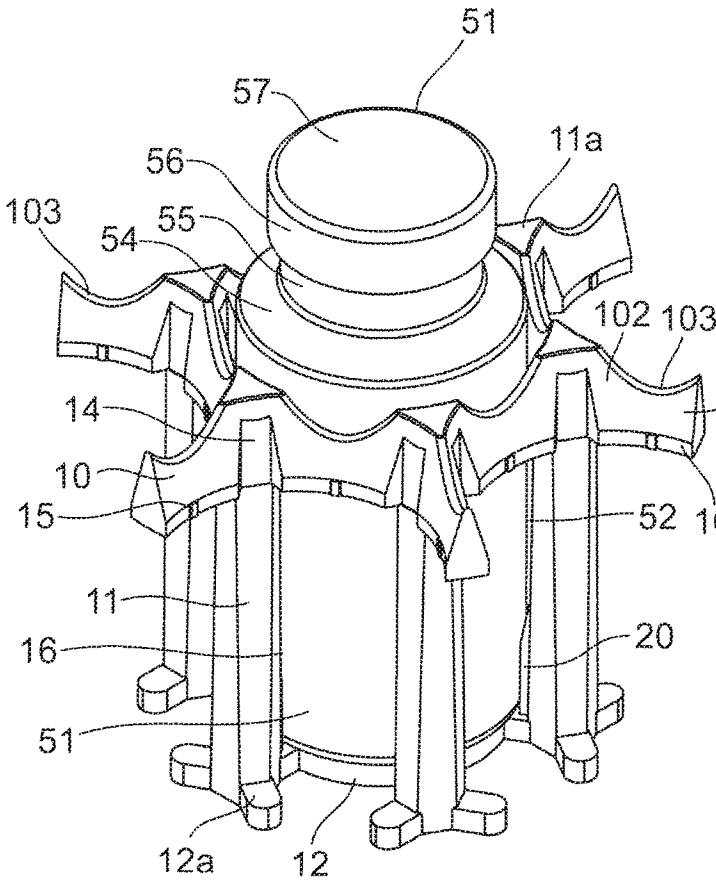
Figure 1C:
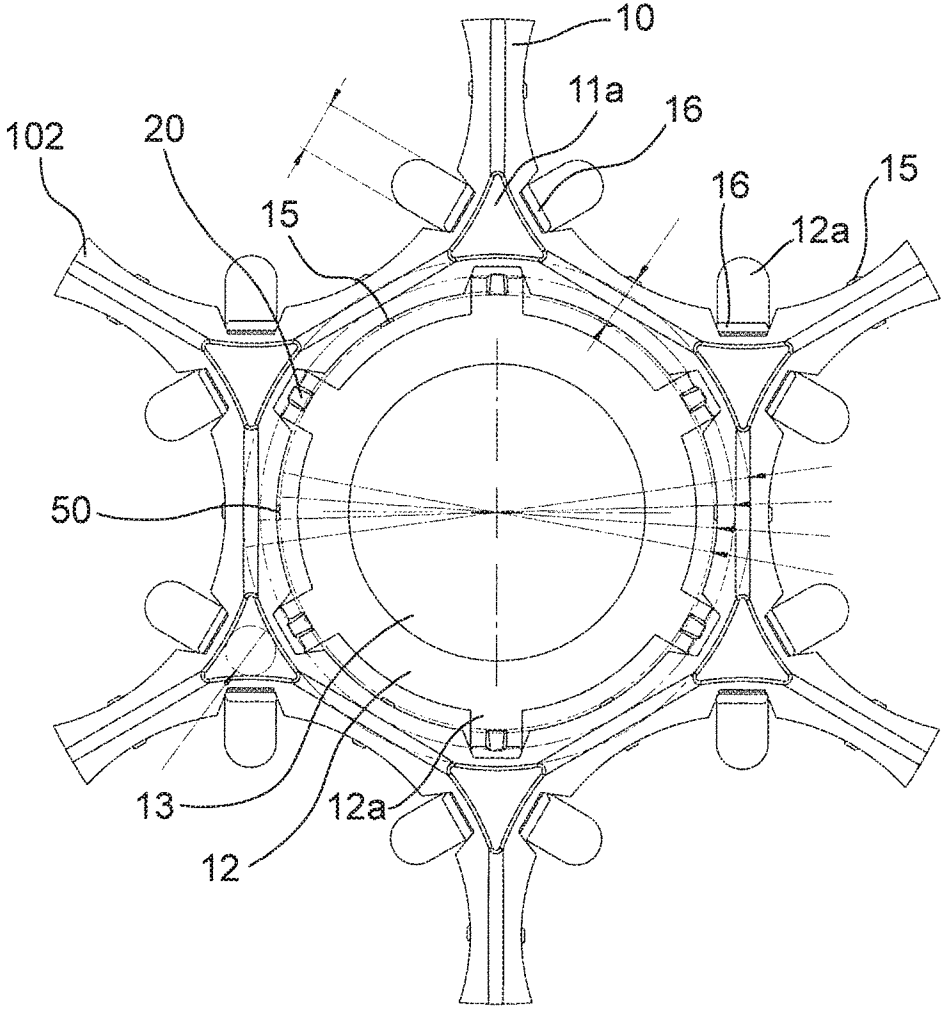
FIGS. 1*c* and 1*d* show a plan view of the base unit according to FIGS. 1*a* and 1*b* without containers and with containers held therein, respectively.
Figure 1D:
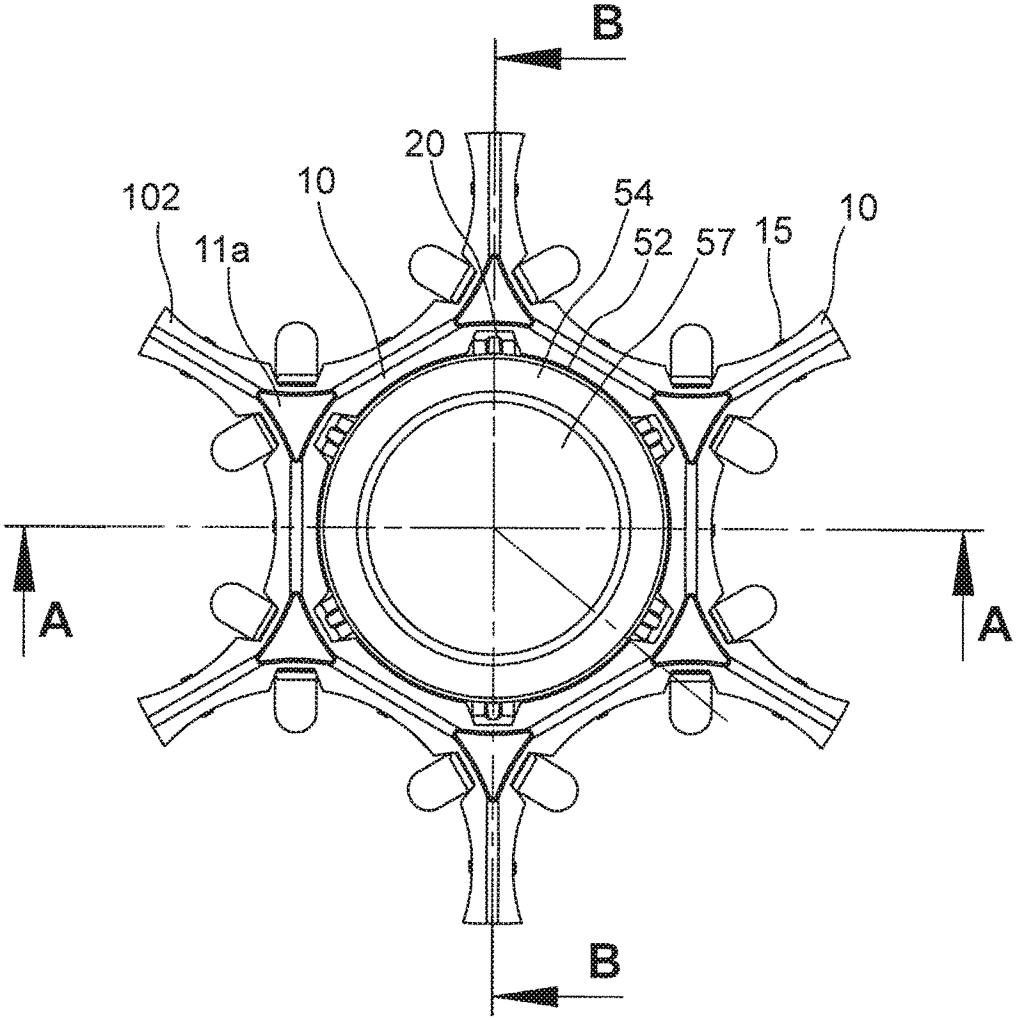
Figure 1F:
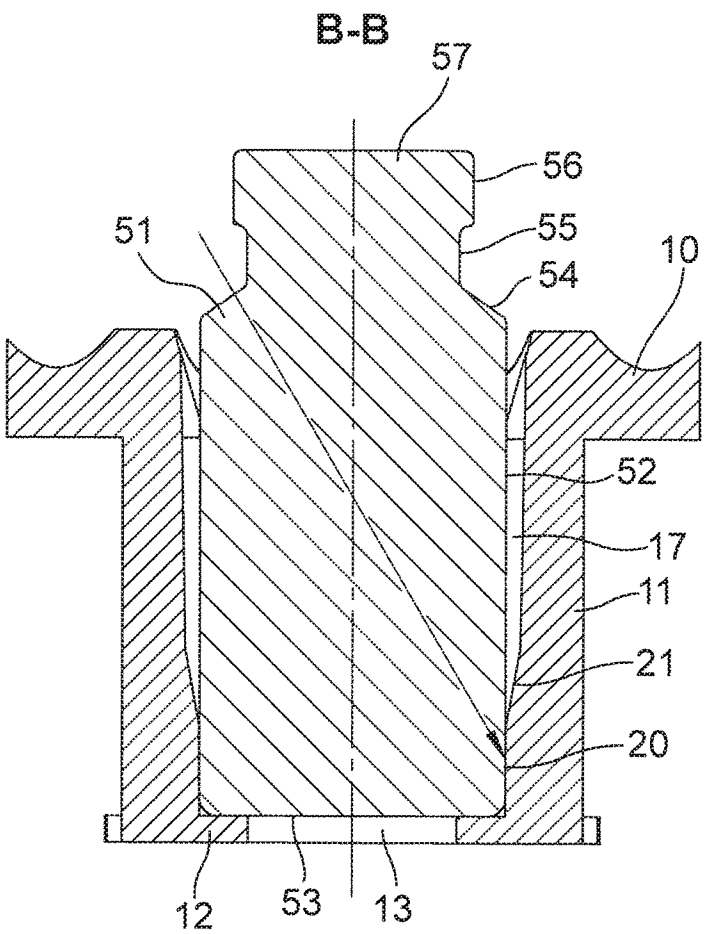
FIGS. 1*e* and 1*f* show the base unit of FIG. 1*d* in a longitudinal section along A-A and along B-B of FIG. 1*d*, respectively.
Figure 1E:
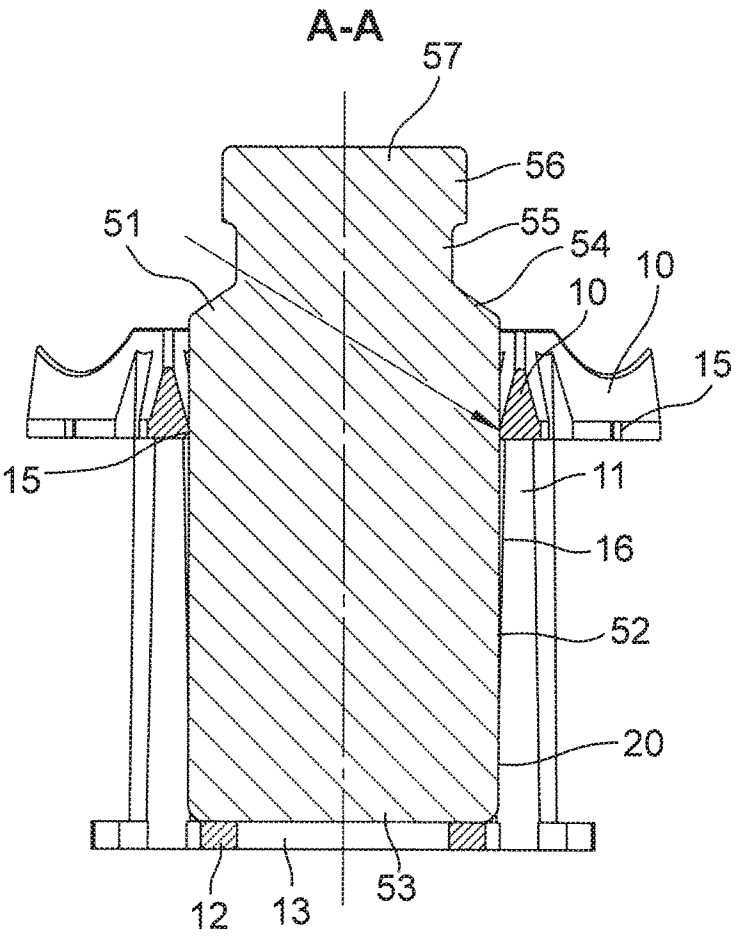
Figure 1G:
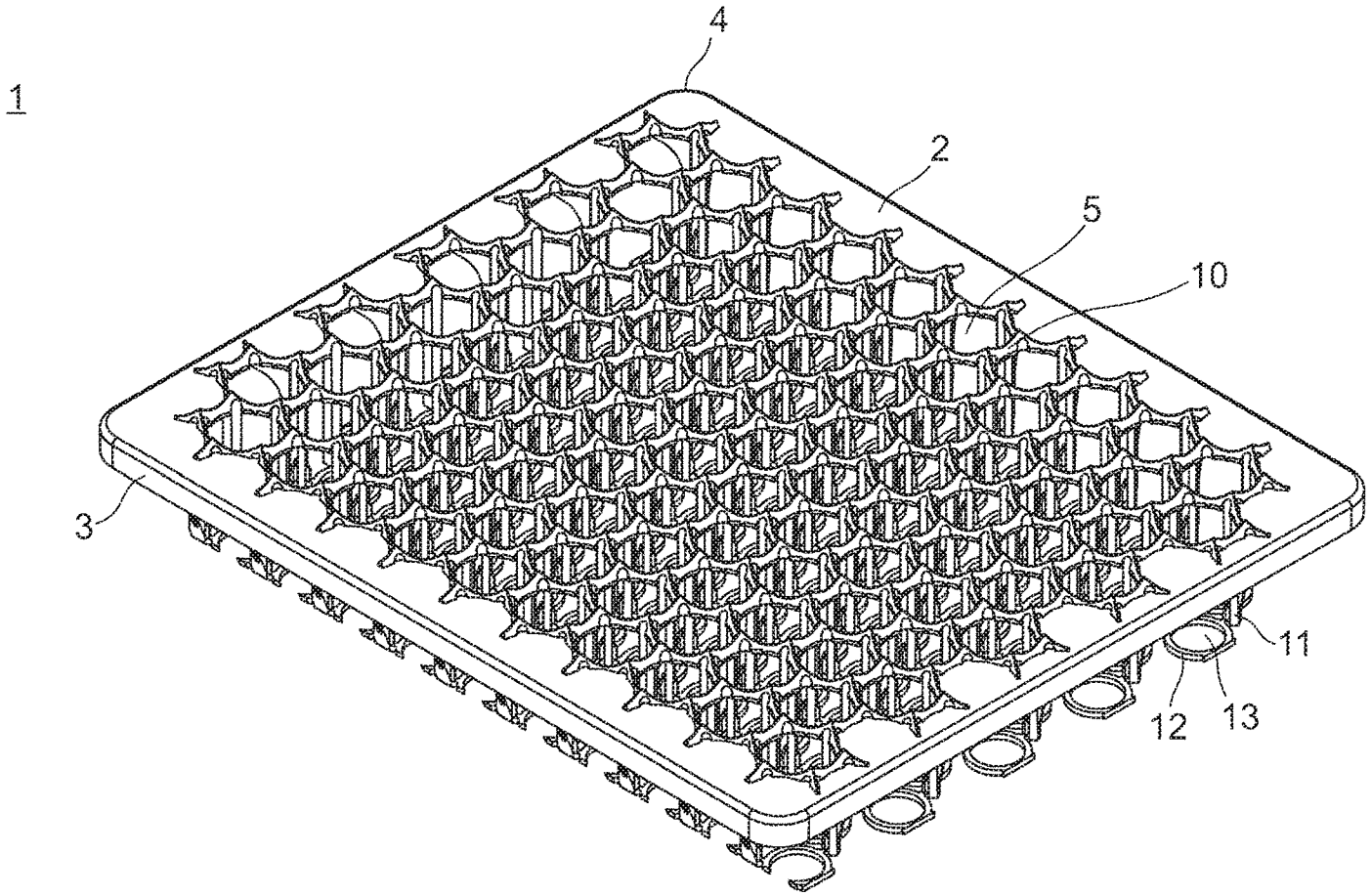
FIG. 1*g* is a perspective plan view of a supporting structure according to the first embodiment with several base units of FIG. 1*c*.

FIG. 1*g* shows the general configuration of a supporting structure 1 according to a first embodiment of the present disclosure. The supporting structure 1 has an upper side or base plane 2, which generally is formed as a plate and whose circumferential edge is formed flat as shown in FIG. 1*g*. In the upper side 2, a plurality of openings 5 is formed, which are arranged in rows and columns extending perpendicular to each other, wherein in this exemplary embodiment, the openings 5 of adjacent rows or columns are arranged staggered relative to each other, which enables a higher packing density with the hexagonal arrangement of the peripheral webs 10. A plurality of axial connecting webs 11 protrude perpendicularly from the underside of the supporting structure 1, which are connected to each other at their lower ends via circumferential bottom webs 12. As described in more detail below, receptacles are formed by the axial connecting webs 11 into which the containers can be inserted perpendicularly from above to be accommodated therein. The bottom webs 12 act as retaining portions to support or hold the containers in the receptacles 5 and to delimit their movement within the receptacles in axial direction. At the same time, the axial connecting webs 11 also delimit the radial movement of the containers in the receptacles 5, so that a collision of containers accommodated in directly adjacent receptacles 5 is prevented. The receptacles 5 are used for the storage of pharmaceutical containers, particularly of vials or cartridges.

Access openings 6 in the upper side 2 (cf. FIG. 2*d*), which are displaced relative to each other on two opposite sides of the supporting structure 1, are used to grip the supporting structure 1.

Together, the bottom webs 12 span a plane, which serves to reinforce the receptacles 5 and the supporting structure 1. The bottom webs 12 enclose circular openings 13 at the lower ends of the receptacles 5.

Peripheral webs 10 protrude perpendicularly from the upper side 2 of the supporting structure 1. These are connected to each other in order to further strengthen the upper side 2, wherein each of them forms the upper end of the receptacles 5 and wherein these together act as a catching funnel in order to ease the insertion of the containers into the receptacles 5, as described below.

The receptacles 5 are formed by respective base units, as shown in FIG. 1*a*. These base units adjoin directly to each other and together form the upper side of the supporting structure, so that preferably only the edge of the supporting structure is plate-shaped and planar, as shown in FIG. 1*g*. According to FIG. 1*a* connecting webs 12*a* protrude perpendicularly from the lower ends of the axial connecting webs 11, which each connect to a circumferential bottom web 12 of the receptacle 5. The bottom webs 12 extend perpendicularly to the axial connecting webs 11. Six axial connecting webs 11 each delimit a receptacle 5. At their upper ends the axial connecting webs 11 are connected to each other by means of peripheral webs 10, which are aligned with the circumferential edge of the upper side 2. The peripheral webs 10 each have a wedge-shaped profile 100, whereby a ridge 101 is respectively formed at the lower end of the peripheral webs 10, which extends perpendicularly to the upper side of the supporting structure and thus in parallel with the axial connecting webs 11. If viewed in a plan view onto a respective receptacle, the peripheral webs 10 together enclose a circle of a diameter which is slightly larger than the outer diameter of the containers to be accommodated in the receptacles 5.

The peripheral webs 10 serve to separate the receptacles 5 at their upper ends. The clearance between adjacent axial connecting webs 11 is smaller than the outer diameter of the containers to be accommodated in the receptacles 5, so that the axial connecting webs 11 limit the radial displacement of the containers in receptacles 5 and prevent a collision between containers in directly adjacent receptacles 5. The slots 11*b* between the axial connecting webs 11 enable a visual inspection of the containers accommodated in the receptacles 5. At the same time, a considerable amount of material and weight can be saved because no partition walls are provided between the receptacles 5. Because of the connection of all peripheral webs 10 and of the bottom webs 12 with each other this results in a quite high stiffness of the supporting structure.

As can be seen in FIG. 1*a*, lower guiding and positioning lugs 20 are provided at the lower ends of the axial connecting webs 11, which protrude radially inwards into the receptacles 5, so that the side walls of the containers do not come into contact with the axial connecting webs 11, but abut directly against the guiding and positioning lugs 20 and so that these are guided by them upon insertion into the receptacles 5. The guiding and positioning lugs 20 are preferably relatively short in comparison to the length of the axial connecting webs 11, but may also extend essentially over the entire length of the axial connecting webs 11 in their longitudinal direction. The axial connecting webs 11 have a hexagonal profile, if viewed in a cross-sectional view (cf. also FIG. 2*c*), in correspondence to the hexagonal layout of the supporting structure, as shown in FIG. 1*g*, although other layouts for arranging the receptacles 5 on the supporting structure 1 are generally also conceivable. At the upper ends of the axial connecting webs 11, recesses 14 are formed in the peripheral webs 10, the recesses 14 having side walls which extend perpendicularly to the upper side of the supporting structure, in order to allow the lower connecting webs 12*a* aligned with them to be demolded from an injection mold. The side walls of the axial connecting webs 11 may be inclined by a small angle of inclination to the center line of the receptacles 5, for example by an angle of about 0.5° to about 5.0°.

As shown in FIG. 1*a*, a plurality of upper guiding and positioning lugs 15 are disposed at the peripheral webs 10, preferably at their vertical edge 101. These are also relatively short and preferably do not extend beyond the vertical edge 101. The upper guiding and positioning lugs 15 and the lower guiding and positioning lugs 20 are each arranged along the edge of the receptacles 5 at equal angular distances to each other. The upper and lower guiding and positioning lugs 15, 20 are arranged alternately and at different angles, if viewed in a plan view.

The upper and lower guiding and positioning lugs 15, 20 may extend perpendicularly and in parallel with the centerline of the receptacles 5, but may also be inclined at a small angle of inclination relative to the centerline, e.g. at an angle of inclination of the order of max. 0.5° or max. 1.0°. This results in a linear or point-like or two-dimensional contact at the front ends of the upper and lower guiding and positioning lugs 15, 20 at the contact points of the upper and lower guiding and positioning lugs 15, 20 with the outer walls of the containers to be accommodated, e.g. of the vial shown in FIG. 1*b*.

As can be concluded from the plan view in FIG. 1*c*, the upper and lower guiding and positioning lugs 15, 20 are each arranged along a circle having a diameter which corresponds to the outer diameter of the containers at least in the region of the lower ends of the receptacles 5, so that the containers with their outer walls abut directly against the lower guiding and positioning lugs 20 or, if necessary, so that the containers are arranged at a very small distance from them. The circle enclosed by the upper guiding and positioning lugs 15 basically may have the same diameter as the circle enclosed by the lower guiding and positioning lugs 20, so that the containers are closely fitted in the receptacles 5 in the region of both the upper guiding and positioning lugs 15 and the lower guiding and positioning lugs 20. In principle, however, the circle enclosed by the upper guiding and positioning lugs 15 may also have a slightly larger diameter than the circle enclosed by the lower guiding and positioning lugs 20, so that the containers may be accommodated with a slightly larger radial clearance in the region of the upper peripheral webs 10 than at their lower ends.

The accommodation of a vial in such a receptacle of a base unit according to the first embodiment is shown in FIGS. 1*d* to 1*f*. The vial 51 has a hollow cylindrical body formed by a cylindrical side wall 52, at the upper end of which a shoulder portion 54 is formed, which merges into a narrowed neck portion 55, at the upper end of which a widened rim portion 56 (with or without external thread) is formed with a filling opening 57 formed therein. The lower end of the vial 51 is formed by a bottom 53 which is perpendicular to the side wall 52. It can be seen that the lower end of the side wall 52 abuts directly against the front ends of the lower guiding and positioning lugs 20. Furthermore, the side wall 52 on the upper side of the supporting structure abuts directly against the front ends of the upper guiding and positioning lugs 15.

According to another preferred use, a supporting structure according to the present disclosure serves to hold cartridges 58 upside down in the receptacles 5, as shown in FIGS. 6*a* to 6*d*. Cartridges 58 are usually relatively slim and open at both ends. For example, the ejection opening may be provided in the region of the widened upper rim 56 and a filling opening 59 may be provided at the opposite end of the cartridge 58, through which a syringe plug is inserted into the cartridge 58 after filling a liquid into the cartridge 58.

Figure 6B:
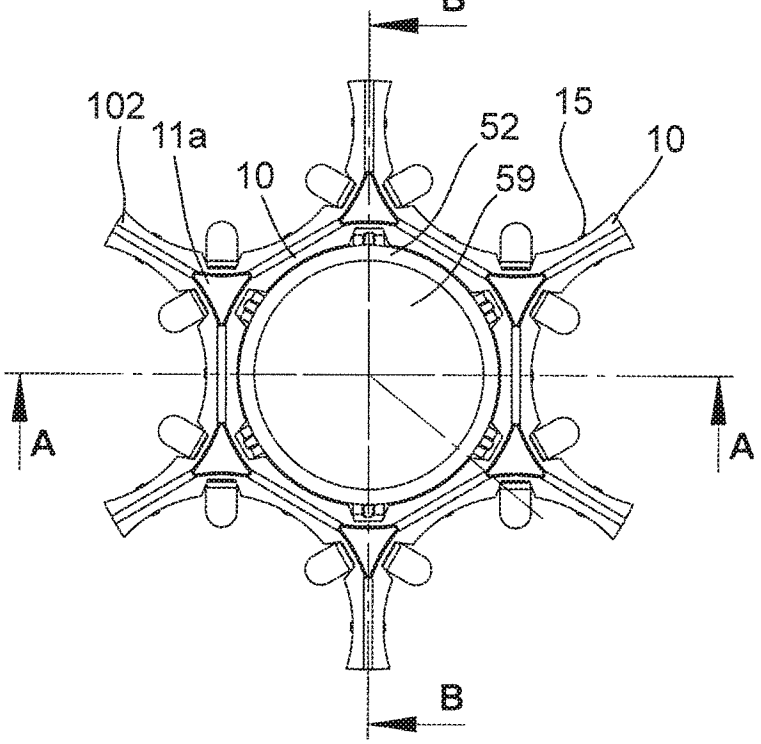
FIG. 6*b* is a plan view of the base unit according to FIG. 6*b* with the cartridge held therein.
Figure 6A:
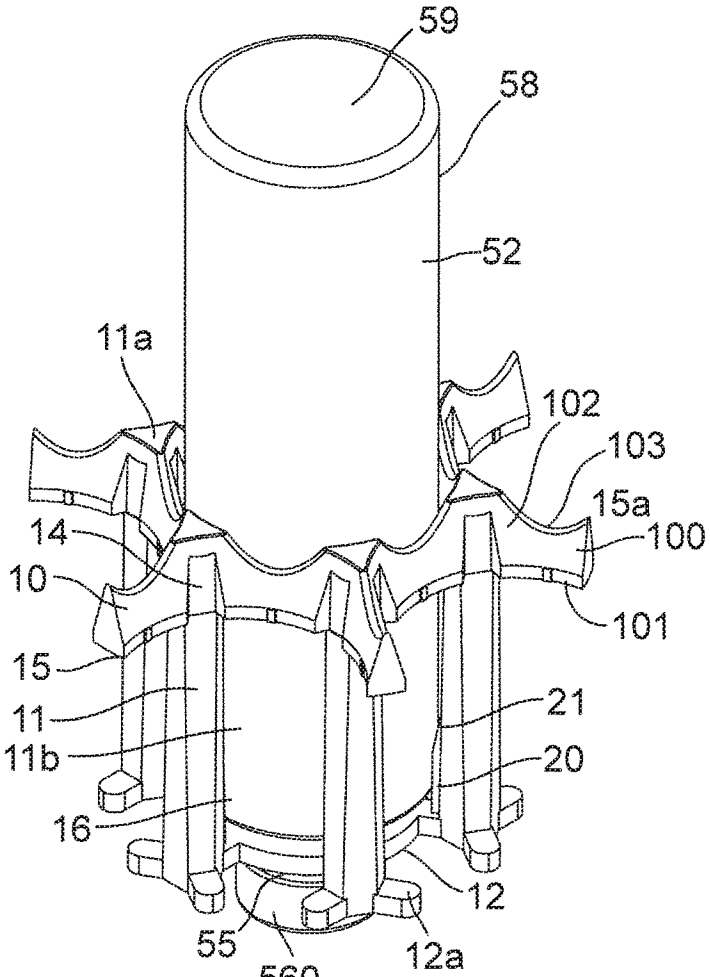
FIG. 6*a* shows a base unit of a modified supporting structure according to the third embodiment of the present disclosure in a perspective view with a cartridge held therein.
Figure 6D:
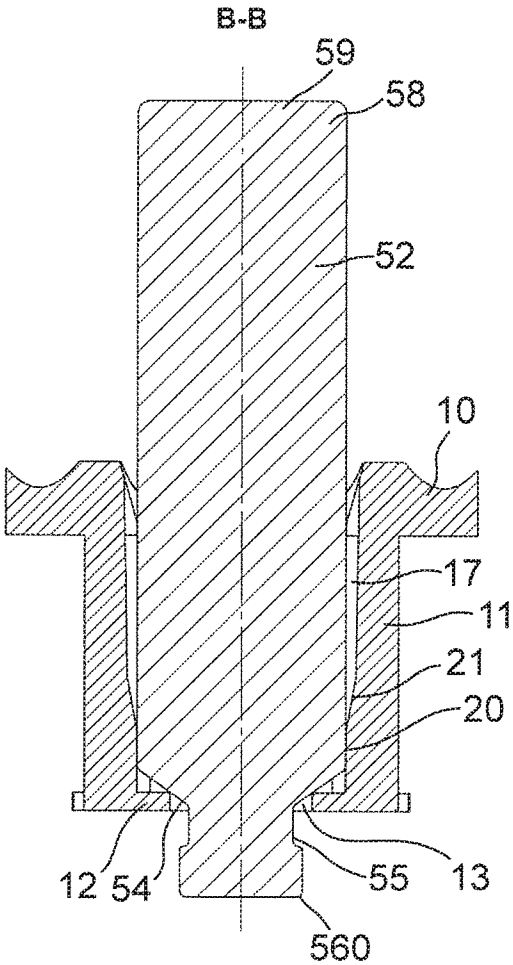
FIG. 6*d* is a partial section along B-B in FIG. 6*b*.
Figure 6C:
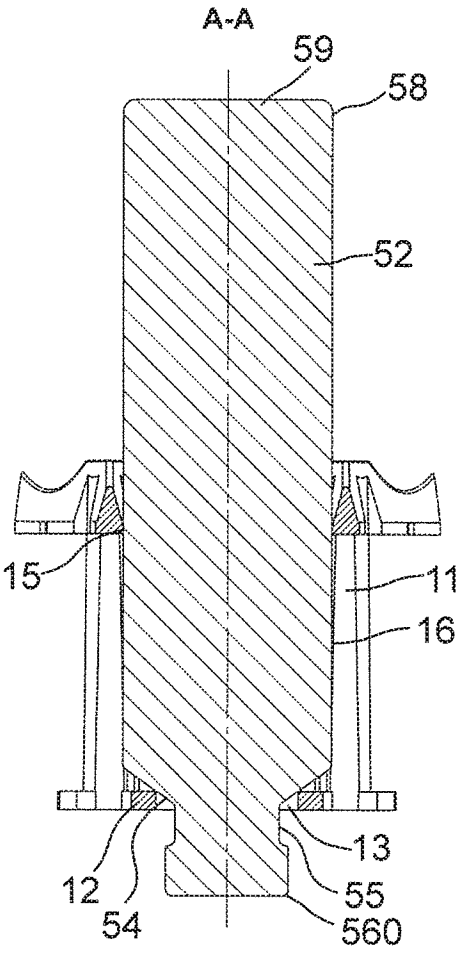
FIG. 6*c* is a partial section along A-A in FIG. 6*b*.

If such a cartridge 58 is accommodated upside down in a receptacle of the base unit described above, as shown in FIG. 6*a* or as shown in the sectional views according to FIGS. 6*c* and 6*d*, the front end of the cartridge 58, including the narrowed neck portion 55 and the widened upper rim 56, extends through the opening 13 in the bottom web 12, including a metal lid 560 crimped on top of it. Here, the metal lid 560 does not come into contact with the bottom web 12, so that no forces are exerted on it and so that the stopper can reliably seal the filling opening 59 of the cartridge 58, even if large axial forces act on the cartridge 58, e.g. during insertion of the syringe plug into the filling opening 59 at the oppose end of the cartridge 58, while the cartridges are accommodated and supported upside down in the receptacles 5. As can be seen in FIGS. 6*c* and 6*d*, the neck portions 54 of the cartridges 58 are directly supported on the bottom webs 12. These bottom webs 12 and also the axial connecting webs 11 are designed with a suitable material thickness for absorbing appropriate forces, e.g. during stoppering. In this position, the opposite ends of the cartridges 58 with the filling openings 59 provided there may protrude out of the receptacles 5.

As can be concluded from FIG. 1*a*, the upper and lower guiding and positioning lugs 15, 20 are formed separately to each other close to the upper and lower ends of the receptacles 5, respectively, i.e. they are designed as separate portions which are independent of each other and are not directly connected to each other or even formed in one piece. Both the upper guiding and positioning lugs 15 and the lower guiding and positioning lugs 20 may thus be arranged at a small distance to the side walls of the containers to be accommodated, so that the packing density of the supporting units can be very high. Relatively long, inclined portions, which were necessary according to the prior art for demolding from an injection mold, are not necessary according to the present disclosure, so that the minimum distances between the molds can be considerably reduced. At the same time, there is a functional separation between the upper guiding and positioning portions 15 and the lower guiding and positioning portions 20, so that in principle a guidance and/or positioning in the region of the upper guiding and positioning portions 15 is possible independently of the guidance and/or positioning in the region of the lower guiding and positioning portions 20.

According to FIG. 1*c*, the lower ends of the peripheral webs 10 together enclose a circle having a diameter which is larger than the outer diameter of the containers to be accommodated in this region. Here, the lower ends of adjacent peripheral webs 10 enclose the upper end 11*a* of the axial connecting web 11 in a three-fold symmetry, whereby the generally linear upper ridges of the peripheral webs 10 are connected to the tips 11*a* of the axial connecting webs 11, which enables a high stiffness of the upper side of a supporting structure. Particularly, forces may be transferred symmetrically sideways to the peripheral webs 10. The peripheral webs 10 are thus higher at the nodes (dead zones of the layout) and thus locally reinforce the upper side of the supporting structure, corresponding to the expected higher loads in these regions. The axial connecting webs 11, which are formed directly underneath these node areas, also increase the rigidity of the supporting structure. Furthermore, a uniform stiffness is achieved by forming both the upper side or base plane of the supporting structure and the bottom plane (contact surface of the containers) in a closed, planar structure. The axial connecting webs 11 connect the upper side or base plane of the supporting structure to the bottom plane and thus form a rigid sandwich structure.

The upper ridges of peripheral webs 10 extend from the axial connecting webs 11 in an arch-shape toward central portions 103 having a smaller height. At these central portions 103 additional connecting webs may be provided for further stiffening, as described in more detail below with reference to FIG. 4*a*.

Since the side flanks of the wedge-shaped peripheral webs 10 serve as insertion bevels for catching and guiding the containers perpendicularly from above into the receptacles 5. Since the side flanks of the wedge-shaped peripheral webs 10 together form a catching funnel having a significantly larger opening width than the outer diameter of the containers, according to the present disclosure the containers only need to be pre-positioned relative to the receptacles 5 with relatively low precision, e.g. by grippers or robots, which reduces the efforts for automation. After the containers have been pre-positioned relative to the receptacles 5, generally these may be released and slide freely into the receptacles 5.

FIG. 1*b* shows a vial 51 inserted upright into a receptacle 5 of such a supporting unit. If a vial 51 is inserted perpendicularly from above into the receptacle 5, the lower end of the side wall 52 first reaches the region of the catching funnel formed by the peripheral webs 10. When the vial 51 further approaches, the lower end of the side wall 52 comes in contact with the side flank 102 of a peripheral web 10 or of several peripheral webs 10, and is thus guided into the receptacle 5. When the vial 51 further approaches, the side wall finally comes in contact with the upper guiding and positioning lugs 15 and is thereby precisely centered by them relative to the receptacle 5 and further guided into the receptacle 5. When the vial 51 further approaches, the side wall 52 slides along the upper guiding and positioning lug 15 until finally the lower end of the side wall 52 reaches the region of the insertion bevels 21 at the upper ends of the lower guiding and positioning lugs 20 in order to be gently guided by them in between the lower guiding and positioning lug 20. When the vial 51 further approaches, the sidewall 52 finally slides along the insertion bevels 21 and along the lower guiding and positioning lugs 20, until finally the bottom 53 of the vial 51 rests on the bottom web 12. In this state (cf. FIGS. 1*b*, 1*e* and 1*f*), the transition region between the side wall 52 and the shoulder portion 54 of a vial 51 is located at the height of the upper edge of the peripheral webs 10 and is thus arranged above the upper side of the supporting structure so that the upper ends of the vials 51, in particular the widened upper rims 56, or attached stoppers can be gripped again by grippers or robots in a simple manner. Also if the vials 51 are pulled out perpendicularly upwards out of the receptacles 5, these are precisely guided by the upper and lower guiding and positioning lugs 15, 20. This minimizes undesired material abrasion at the front ends of the guiding and positioning lugs 15, 20 during both insertion and removal of the containers.

As can be concluded from FIGS. 1*a*, 1*c* and 1*g*, the upper ends 11*a* of the axial connecting webs 11 on the upper side or base plane 2 of the supporting structure 1 represent the highest elevations or the highest points, which are also provided with insertion bevels. The lower ends of the containers thus first cooperate with the insertion bevels at the upper ends 11*a* of the axial connecting webs 11 when lowered perpendicularly from above onto supporting structure 1 for insertion into receptacles 5. These also play an important role for guidance. Because the upper ends 11*a* and the axial connecting webs 11 are arranged along the upper end of a respective receptacle 5 in a distributed arrangement, these together effectively catch the containers already at a very early stage of lowering the containers perpendicularly from above in order to guide them into the receptacles. As can be concluded from FIG. 1*c*, these upper ends 11*a* or connecting webs 11 are provided in dead zones of the layout of the supporting structure 1, i.e. where adjacent webs 10 intersect each other. The axial connecting webs 11 can therefore be relatively strong without reducing the packing density of the supporting structure 1. Since the axial connecting webs 11 contribute significantly to the stiffness of the supporting structure 1, the wall thickness of the peripheral webs 10 can be minimized according to the present disclosure, which not only effectively increases the packing density that can be achieved, but which also helps to significantly reduce the material costs and the total weight of the supporting structure 1.

Figure 1H:
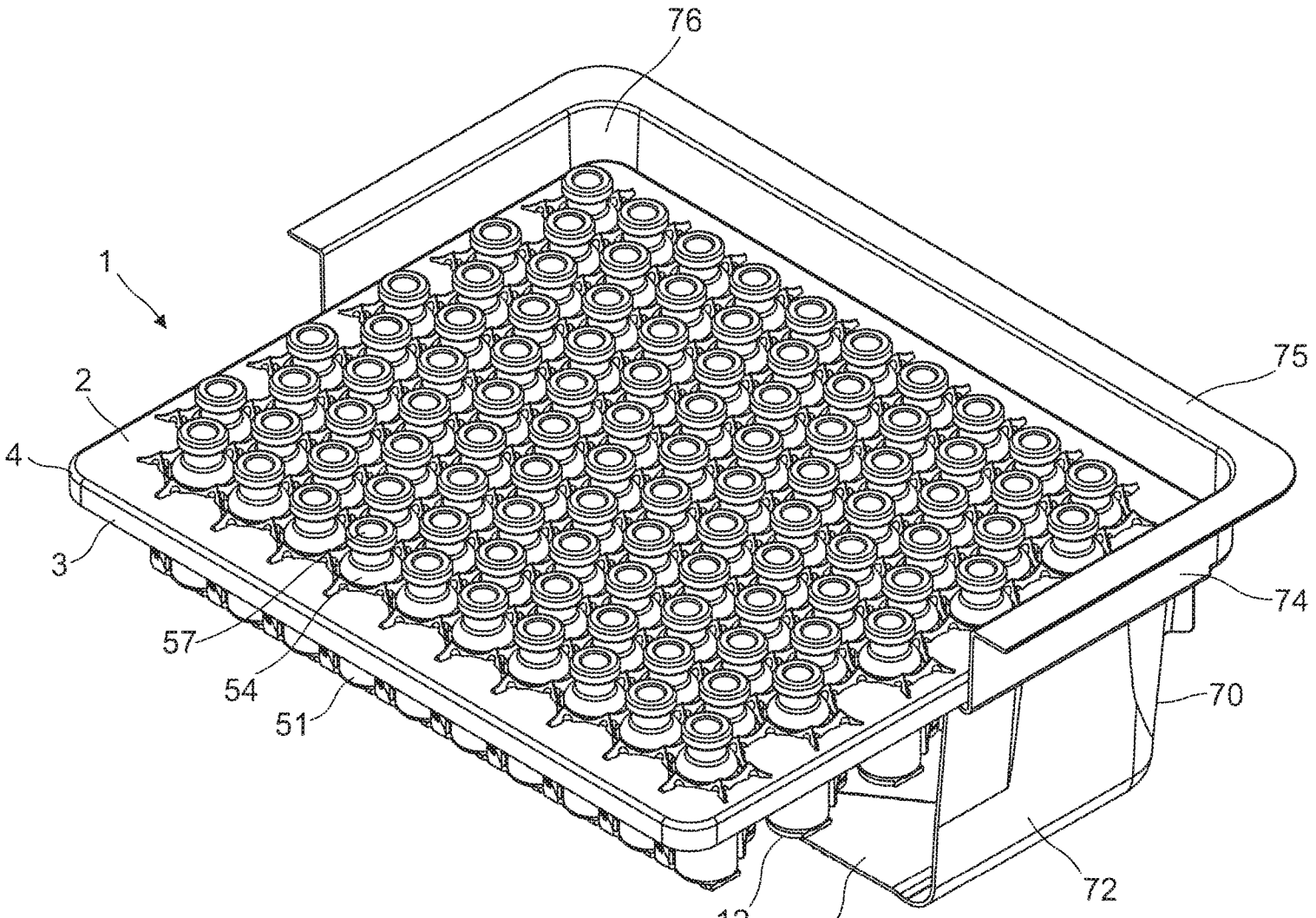
FIG. 1*h* is a perspective partial section of a transport and packaging container with a supporting structure according to FIG. 1*g*.

As shown in FIG. 1*h*, the upper side 2 of the supporting structure 1 is further reinforced by a circumferential edge 3, which protrudes perpendicularly downwards from the upper side 2. In order to further reinforce the supporting structure, also two stiffening ribs may be provided on the rear of the upper side 2.

A supporting structure 1, as described above, can be used for storage and transport of pharmaceutical containers such as vials or cartridges. For handling, the supporting structure 1 can be gripped and guided by grippers or the like via access openings 6 (cf. FIG. 2*d*). The pharmaceutical containers can be further processed or treated while being supported by the supporting structure 1 as described above. For sterile transport, such a supporting structure may be stored as a so-called nest in a tub-shaped transport or packaging container 70 (so-called tub), as shown in FIG. 1*h*, which may be of the kind disclosed in EP 2 868 593 A1 of the Applicant, the content of which is hereby incorporated by reference for disclosure purposes.

According to FIG. 1*h*, the transport and packaging container 70 is configured essentially as a box or tray and has a bottom 71, a circumferential side wall 72 protruding perpendicularly from it, a step 73 protruding substantially perpendicularly from it, a circumferential upper side wall 74 and an upper rim 75, which is formed as a flange and has corners 76 which are suitably rounded. Such a transport and packaging container 70 is preferably made of a plastic material, in particular by plastic injection molding technology, preferably of a clear, transparent plastic material, in order to enable a visual inspection of the containers 51 held by the supporting structure 1. The transport and packaging container 70 may be closed or sealed by means of a gas-permeable plastic film, in particular by means of a plastic film formed from a gas-permeable mesh of plastic fibers and in particular a Tyvek® film.

Figure 2A:
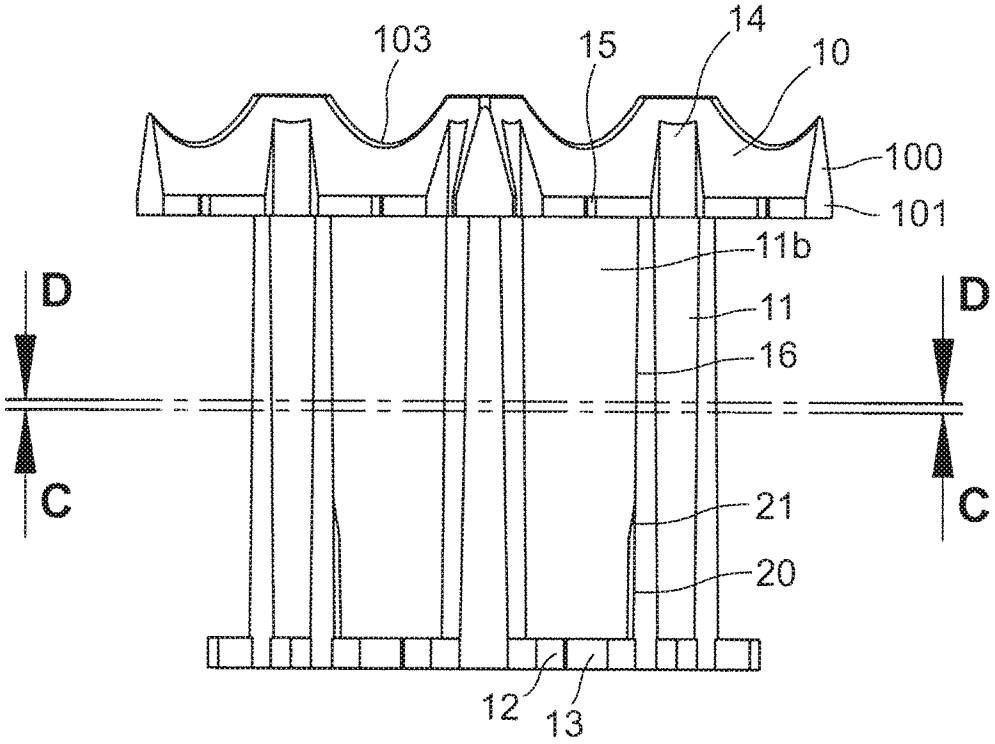
FIG. 2*a* shows a base unit of a supporting structure according to a second embodiment of the present disclosure a side view without a container held therein.
Figure 2B:
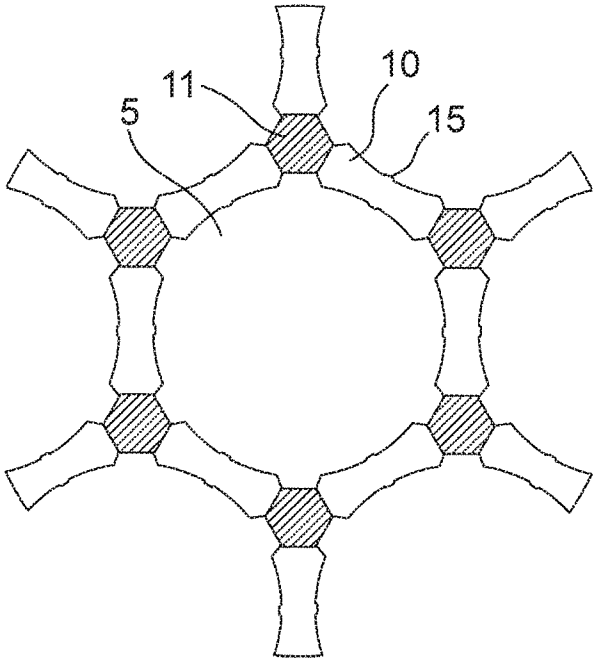
FIGS. 2*b* and 2*c* show the base unit according to FIG. 2*a* in a longitudinal section along C-C and along D-D according to FIG. 2*a*, respectively.
Figure 2C:
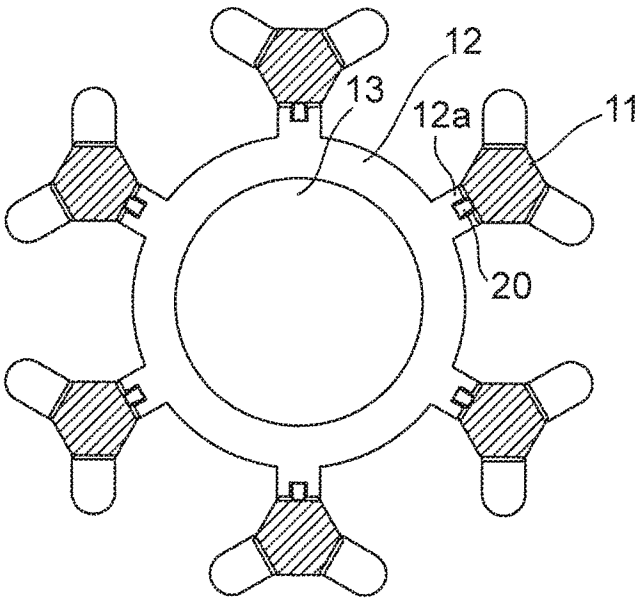

FIGS. 2*a*-2*c* show the general structure of a base unit of a supporting structure according to a second embodiment of the present disclosure, in which the axial connecting webs 11 have a hexagonal profile and are formed in one piece with the peripheral webs 10.

Figure 2D:
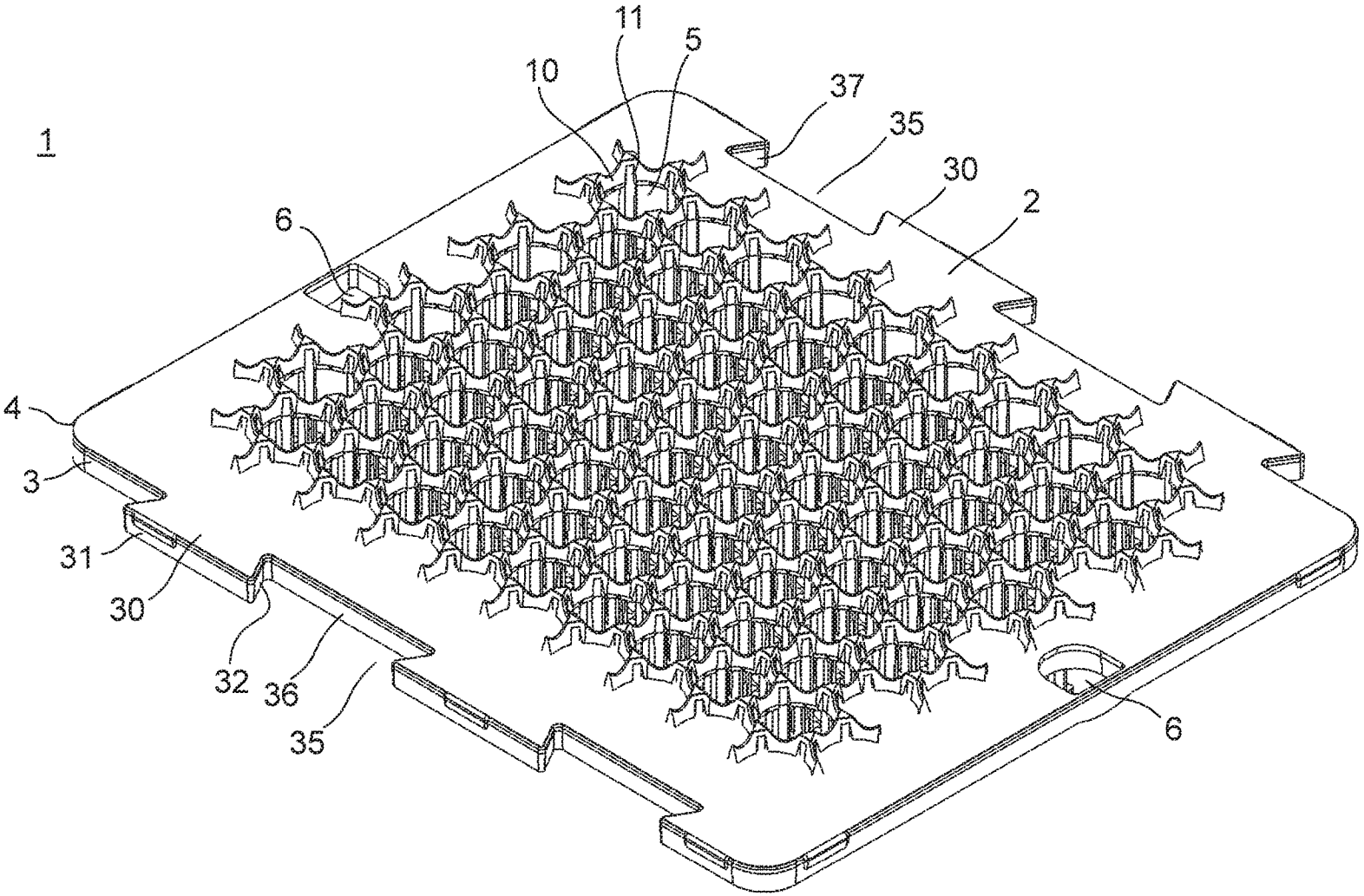
FIG. 2*d* is a perspective plan view of a supporting structure according to the second embodiment with several base units according to FIG. 2*a*.
Figure 2E:
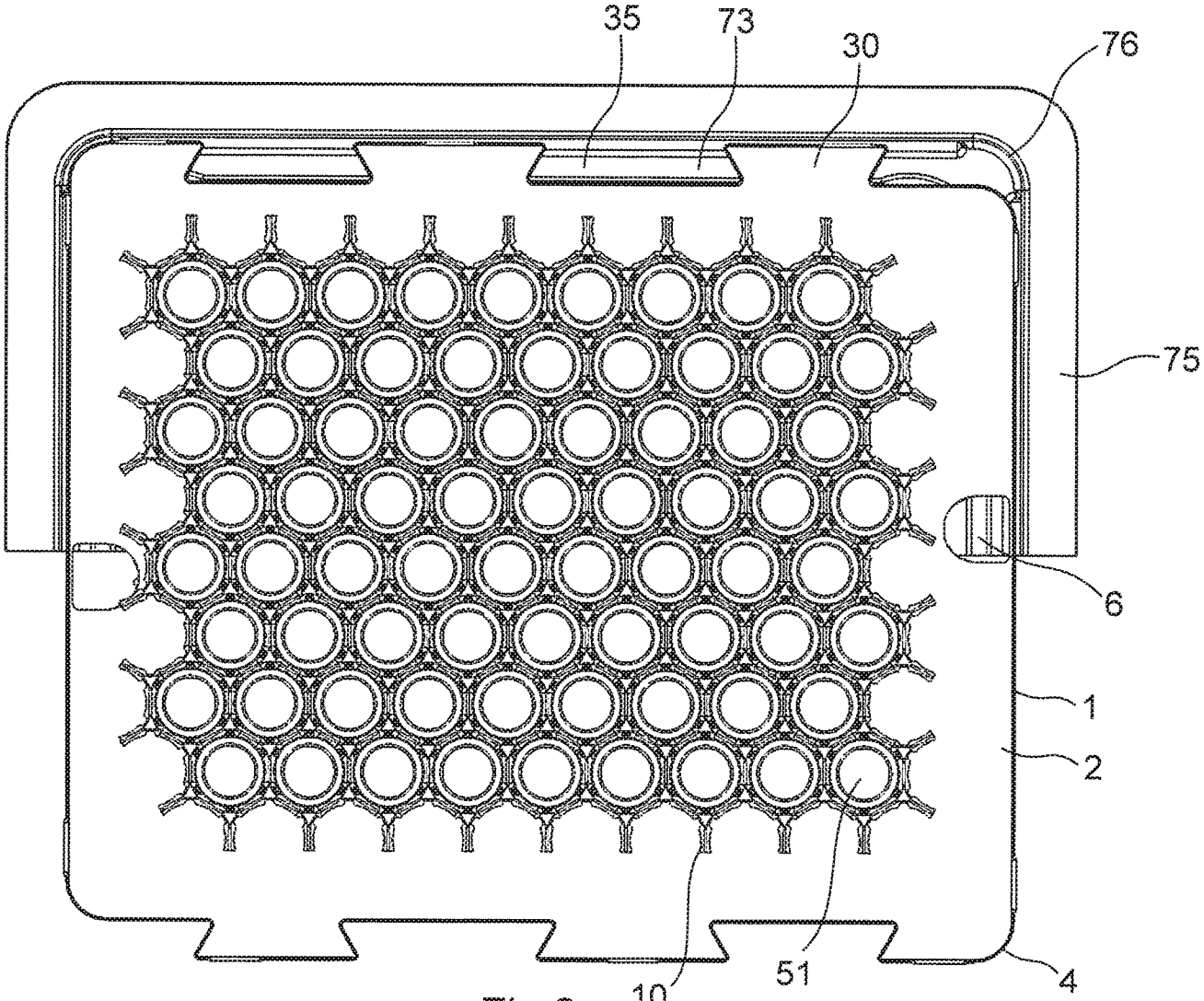
FIG. 2*e* is a plan view of the supporting structure according to FIG. 2*d* which is accommodated in a transport or packaging container shown in a partial section.

FIG. 2*d* shows a supporting structure according to the second embodiment with such base units. As a difference to the first embodiment, supporting structures of identical configuration may be concatenated with each other, as disclosed in more detail in WO2014/009037 A1 of the Applicant, the content of which is hereby expressly incorporated by reference. According to FIG. 2*d*, a plurality of protrusions 30 and recesses 35 are formed alternately along the two longitudinal sides of the supporting structure 1 and at regular intervals from each other, each of which having a triangular or polyhedral base area, if viewed in a plan view, and being formed corresponding to each other. A latching of two supporting structures 1 can be achieved by a form-fit coupling of protrusions 30 and recesses 35 in the manner of a dovetail coupling. FIG. 2*e* shows the accommodation of such a supporting structure 1 in a transport and packaging container 70, as described above.

Figure 3A:
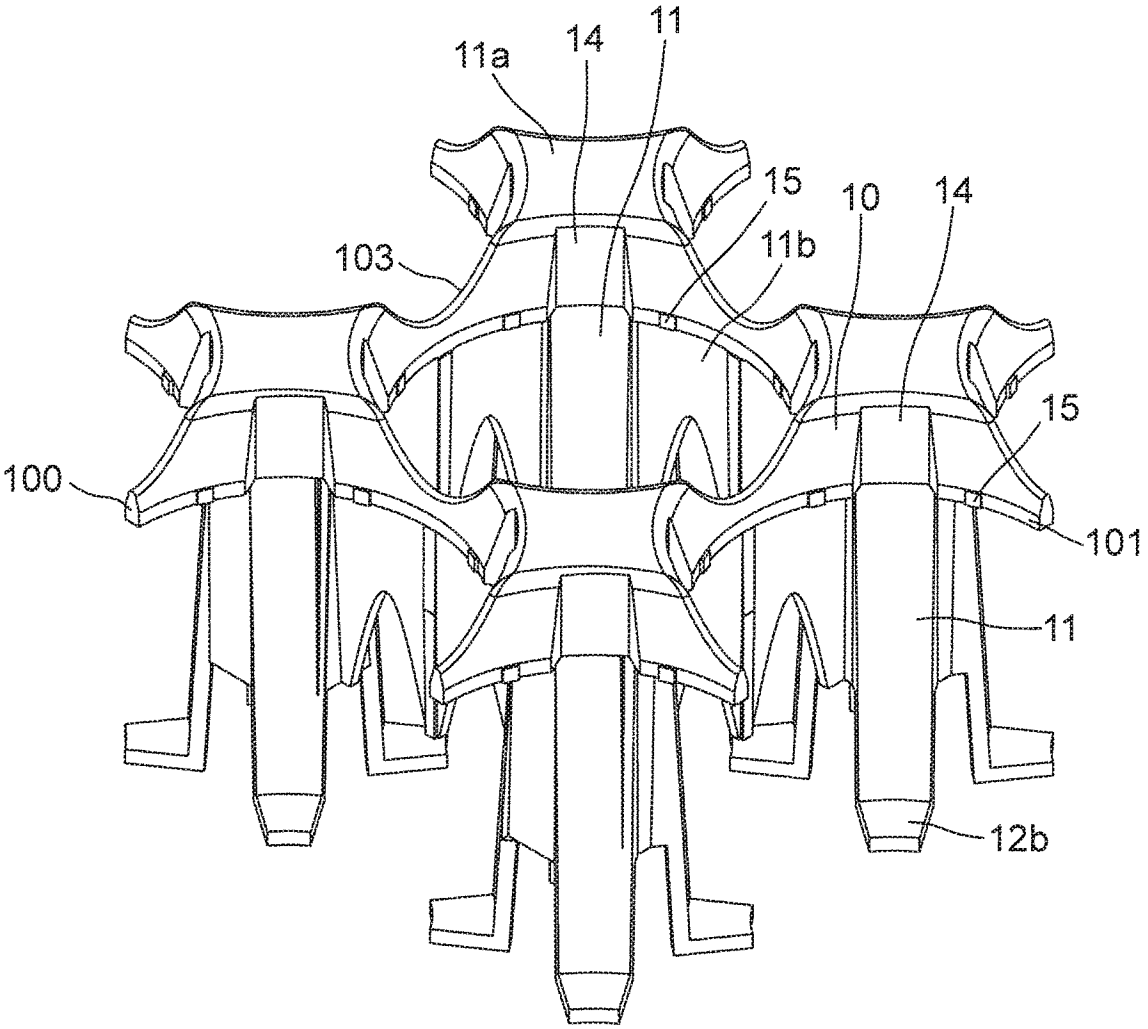
FIGS. 3*a* and 3*b* show a base unit of a supporting structure according to a third embodiment of the present disclosure in a perspective view, namely without containers and with containers held therein, respectively.
Figure 3B:
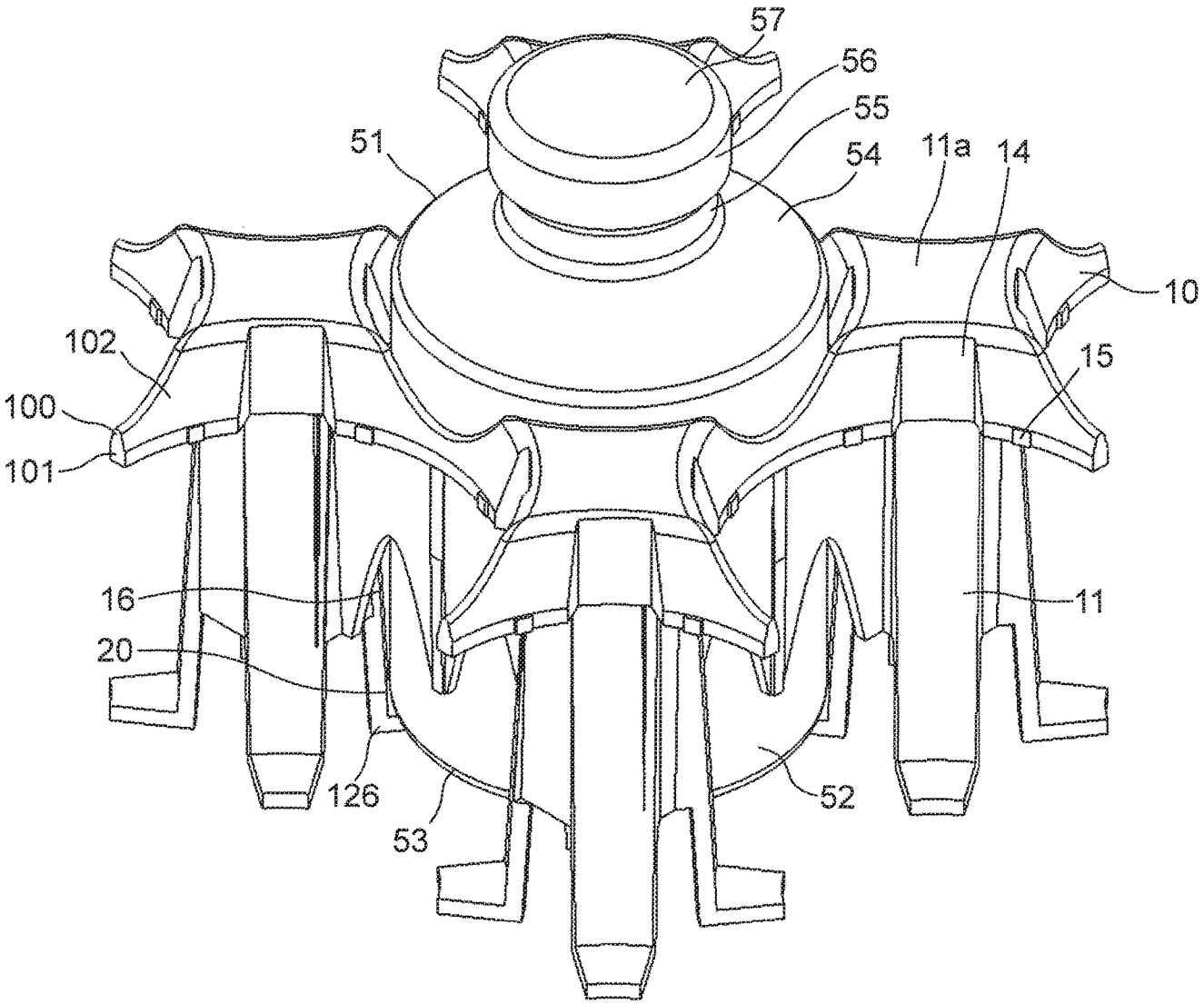
Figure 3C:
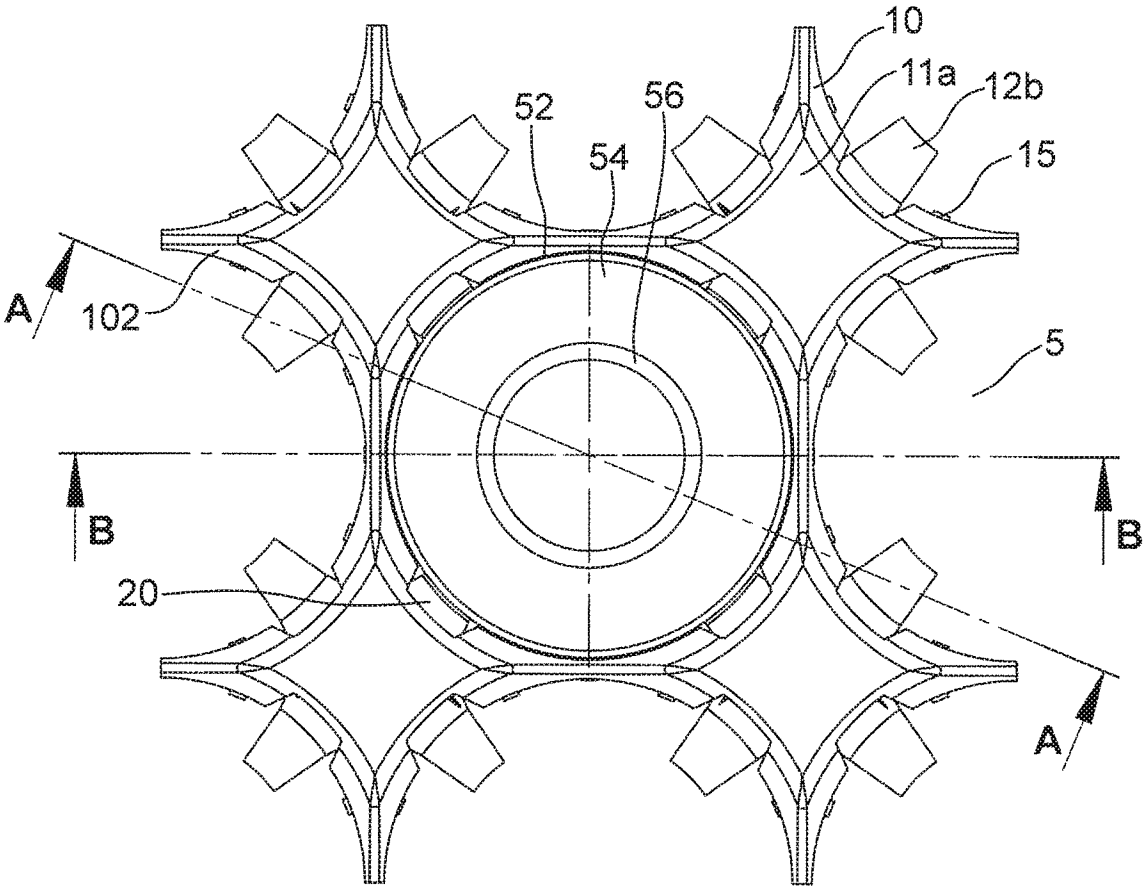
FIG. 3*c* is a plan view of the base unit according to FIG. 3*b* with a container held therein.

FIGS. 3*a*-3*c* show the general configuration of a base unit of a supporting structure according to a third embodiment of the present disclosure, in which the upper ends 11*a* of the axial connecting webs 11 are formed in rhombic form. Such a configuration is particularly suitable for a supporting structure in which the receptacles are arranged in rows and columns extending perpendicularly thereto in alignment without lateral offset.

Figure 3E:
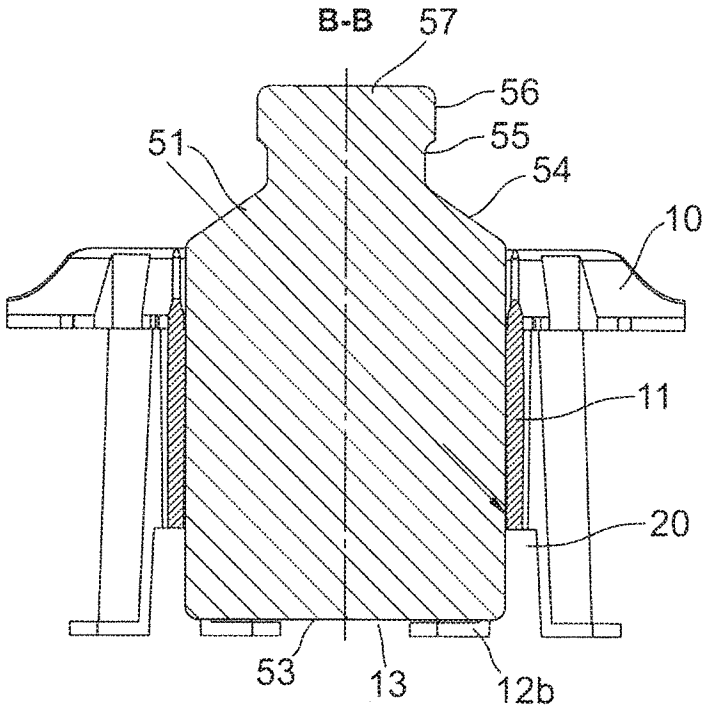
FIGS. 3*d* and 3*e* show the base unit according to FIG. 3*c* in a longitudinal section along A-A and along B-B according to FIG. 3*c*, respectively.
Figure 3D:
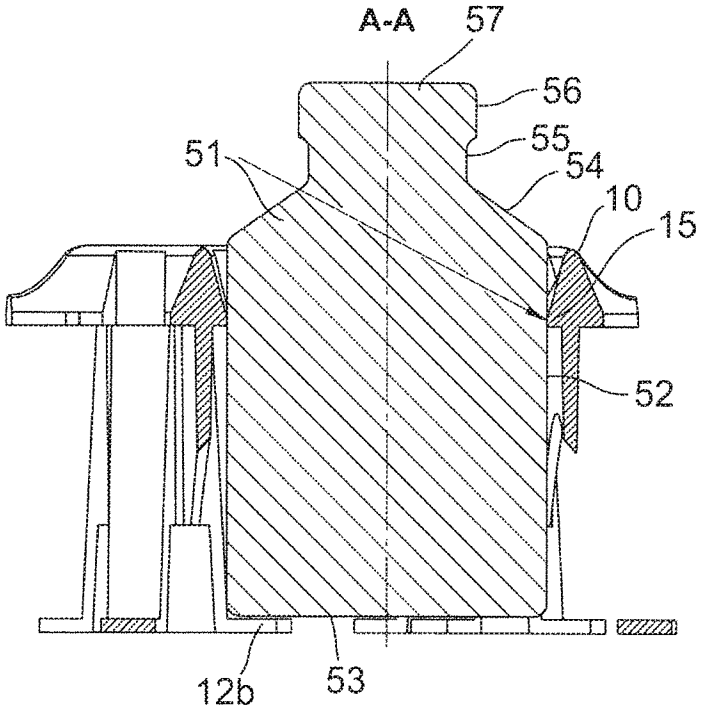

The receptacles 5 are limited by only four axial connecting webs 11, wherein retaining protrusions 12*b* protrude perpendicularly therefrom at their lower ends. As a difference to the previous embodiments, these retaining protrusions 12*b* are not connected to each other via a bottom web, although such a bottom web may in principle also be provided here. However, an adequate stiffness may still be achieved by appropriate material thickness of the lower ends of the axial connecting webs 11 and of the retaining protrusions 12*b*. Such a supporting structure 1 is suitable e.g. for holding vials, as shown in FIGS. 3*d* and 3*e*.

Figure 4A:
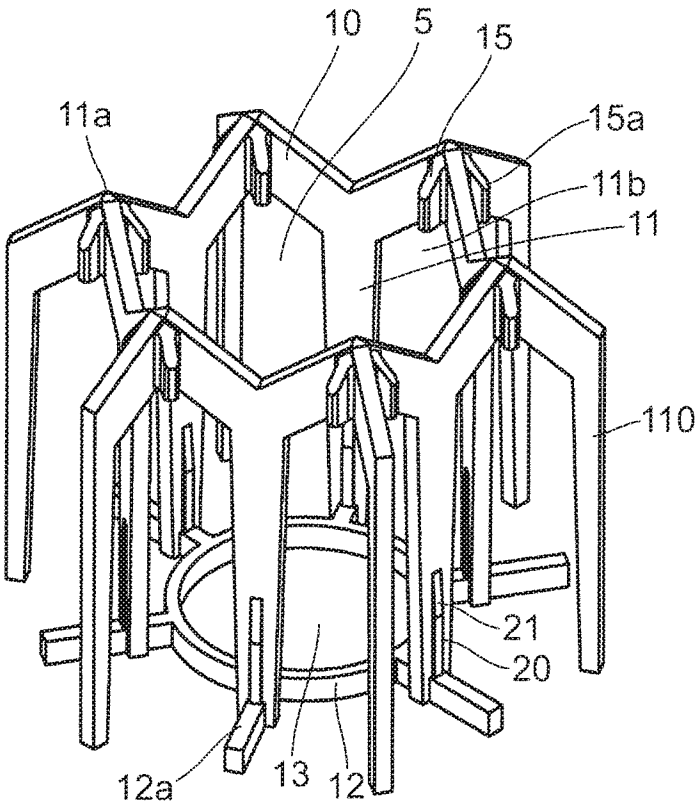
FIGS. 4*a* and 4*b* show a base unit of a supporting structure according to a fourth embodiment of the present disclosure in a perspective view, namely without a container and with a container held therein.
Figure 4B:
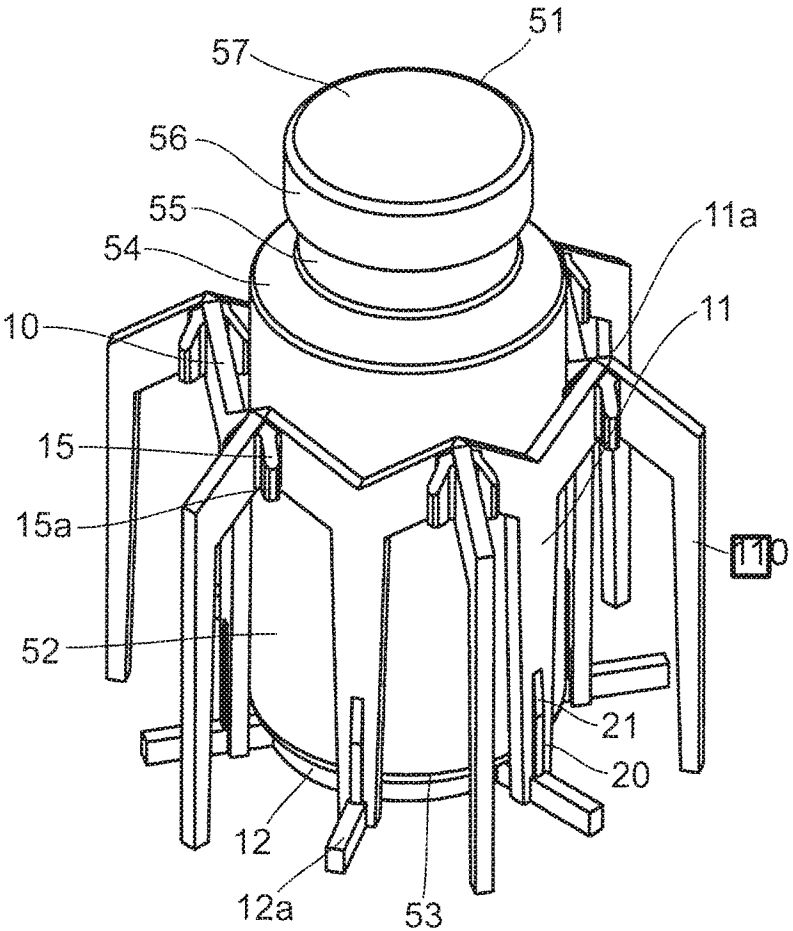
Figure 4C:
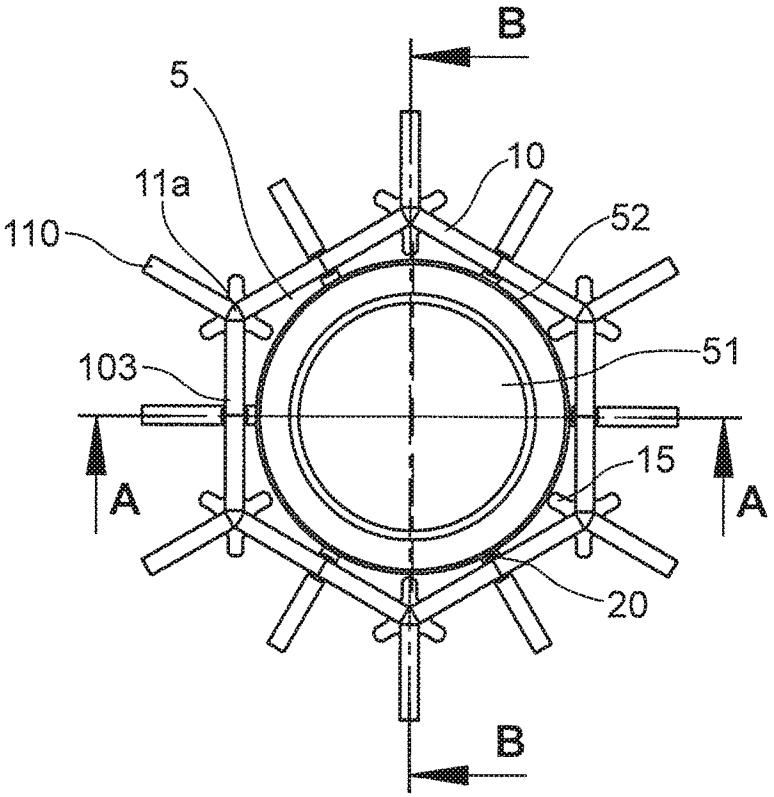
FIG. 4*c* is a plan view of the base unit according to FIG. 4*b* with a container held therein.

FIGS. 4*a*-4*c* show the general configuration of a base unit of a supporting structure according to a fourth embodiment of the present disclosure, where, as a difference to the afore-mentioned embodiment, two types of axial connecting webs 11, 110 are provided. The axial connecting webs 11 extend from the intersection points of the upper peripheral webs 10 first radially outwards and inclined downwards, in order to merge into a portion extending in parallel with and perpendicularly to the centerline of the receptacle 5. The upper guiding and positioning lugs 15 protrude radially inwards into the receptacles 5 from the intersection points of the upper peripheral webs 10. If viewed in a side view, the upper peripheral webs 10 have a triangular jagged course, with upper ends close to the intersection points of the upper peripheral webs 10 and with lower ends at central portions 103 of the peripheral webs 10. Although the peripheral webs have a constant thickness, i.e. no wedge-shaped profile, the material thickness in the axial direction of the receptacles 5 at the central portions 103 is larger, because at these central portions 103 the axial connecting webs 103 begin and because the transition region between the central portions 103 and the axial connecting webs 11 is generally of triangular shape. Due to the lower height of the peripheral webs 10 at the intersection points of adjacent peripheral webs and due to the greater height at the central portions 103, also a locally adapted stiffness of the peripheral webs 10 may be generated, comparable to a simple beam in bending, in which a deflection can be reduced by making the material thicker towards the center (corresponding to the region at the central portions 103) and thus an efficient reinforcement is accomplished. This effect is further enhanced by the axial connecting web 11.

In this embodiment, the lower ends of the axial connecting webs 11, 110 are connected to each other, e.g. via the lower connecting webs 12*a* shown, so that also the underside of the supporting structure has a high stiffness.

Figure 4E:
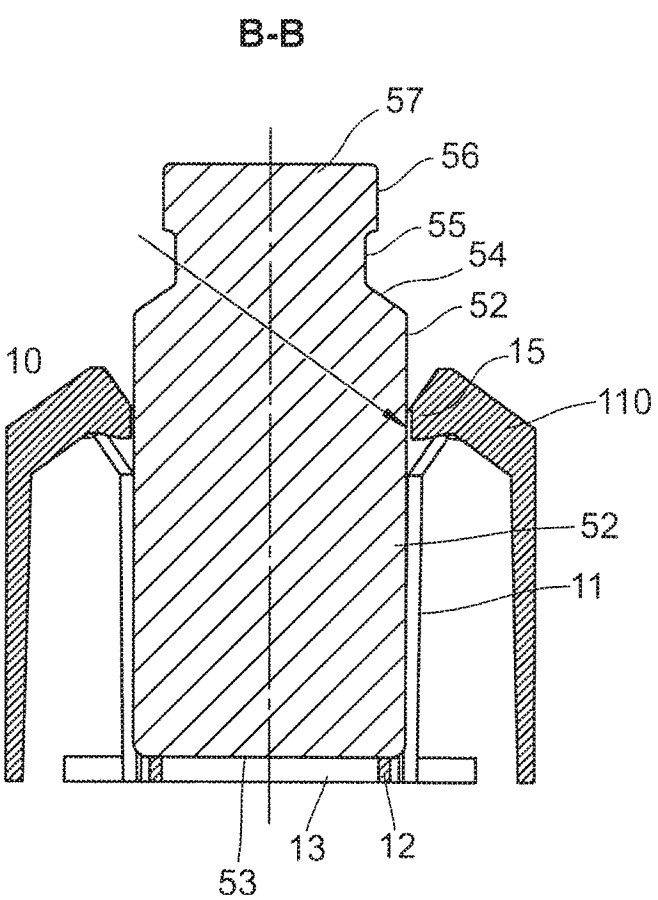
FIGS. 4*d* and 4*e* show the base unit according to FIG. 4*c* in a longitudinal section along A-A and B-B according to FIG. 4*c*, respectively.
Figure 4D:
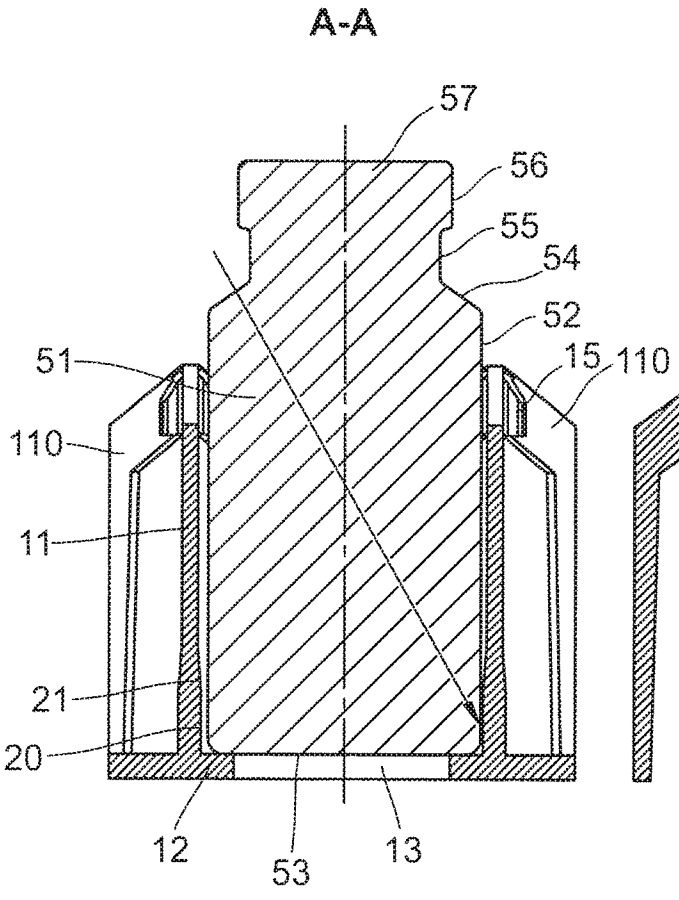
Figure 4F:
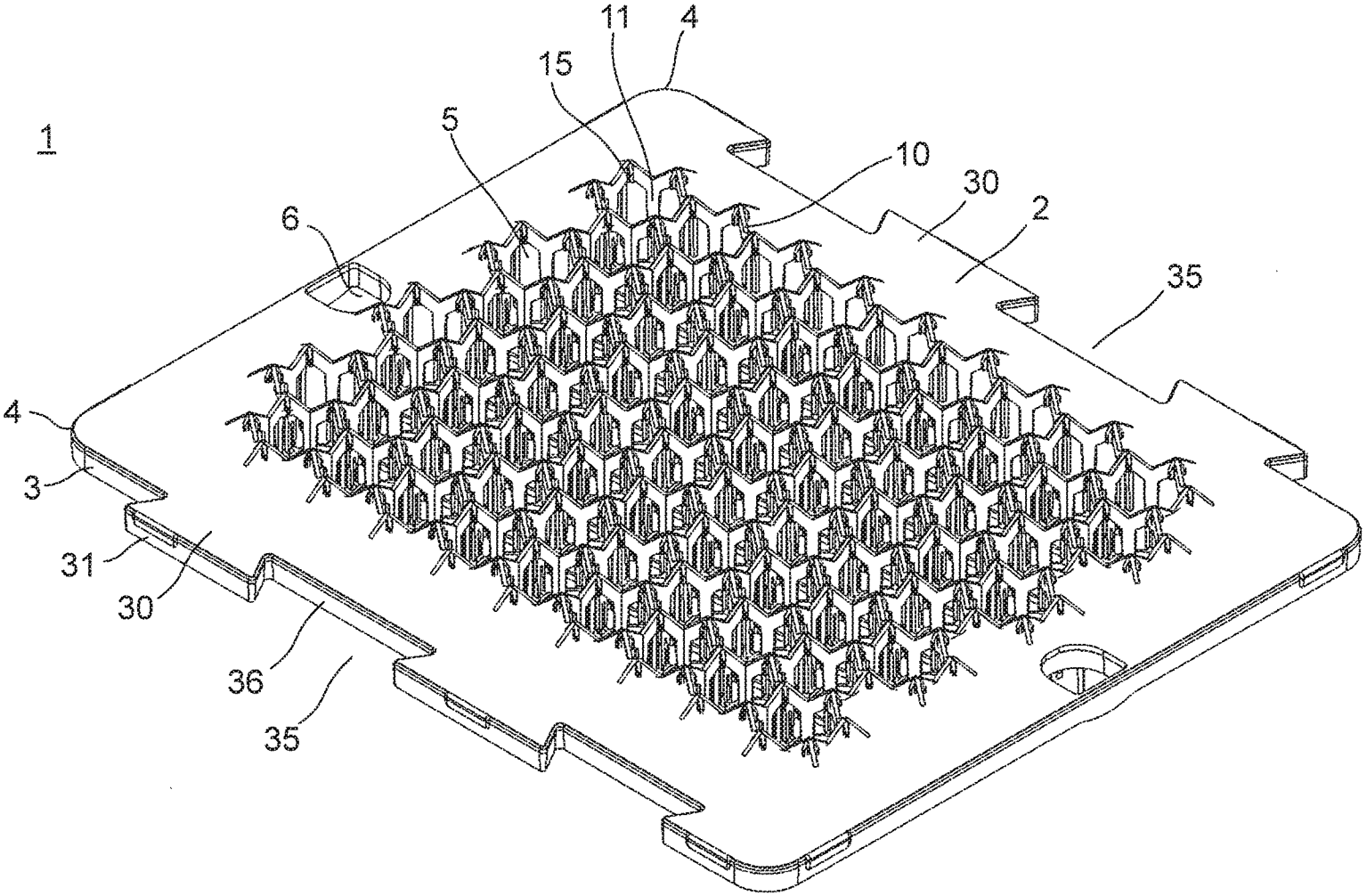
FIG. 4*f* is a perspective plan view of a supporting structure according to the fourth embodiment with several base units according to FIG. 4*a*.

FIGS. 4*d* and 4*e* show the accommodation of a vial 51 in such a base unit in a longitudinal section along A-A and B-B, respectively, according to FIG. 4*c*. FIG. 4*f* shows a supporting structure 1 comprising a plurality of such supporting units, which is provided with protrusions 30 and recesses 35 along the edge according to the second embodiment.

A supporting structure 1, as described above, can be formed in one piece particularly by injection molding from a plastic material.

Figure 5A:
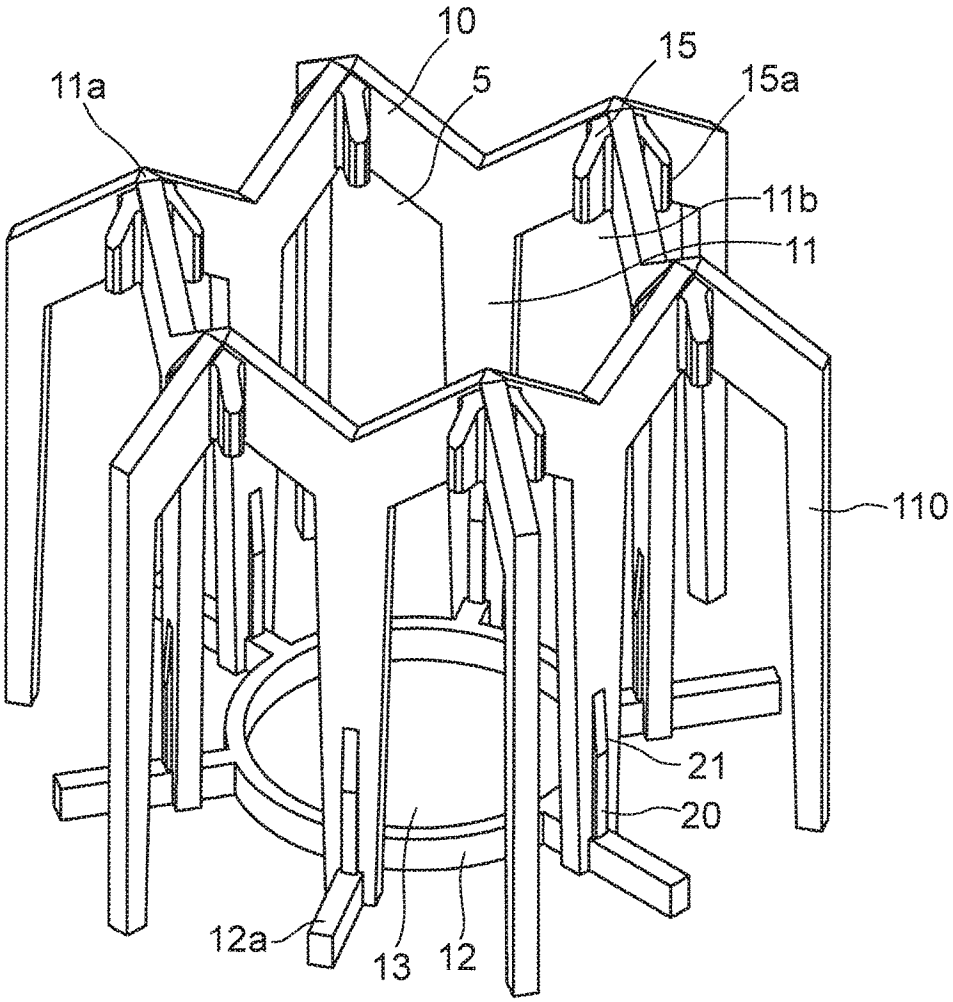
FIG. 5*a* shows a base unit of a modified supporting structure according to the fourth embodiment of the present disclosure in a perspective plan view.
Figure 5C:
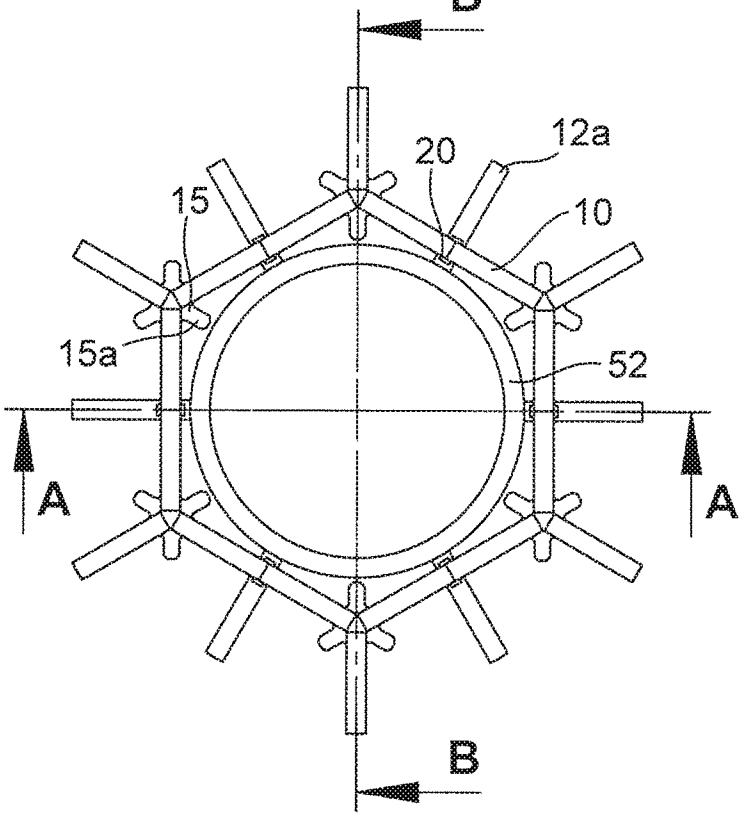
FIG. 5*c* is a plan view of the base unit according to FIG. 5*b* with the cartridge held therein.
Figure 5B:
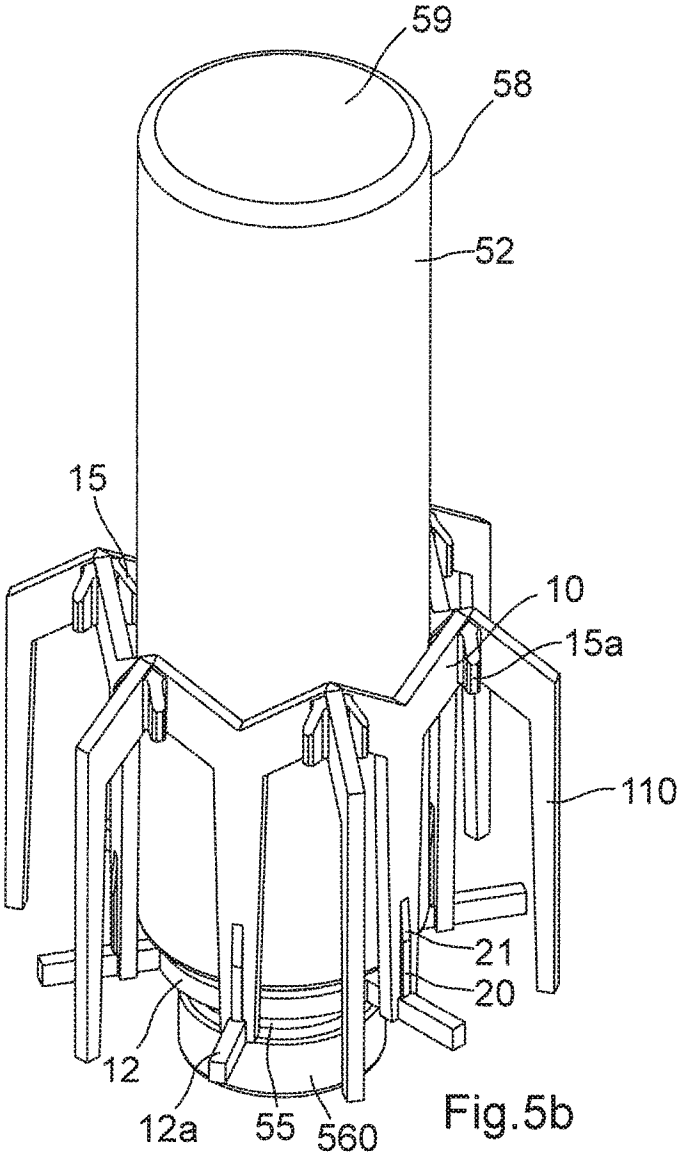
FIG. 5*b* shows the base unit according to FIG. 5*a* with a cartridge held therein.
Figure 5E:
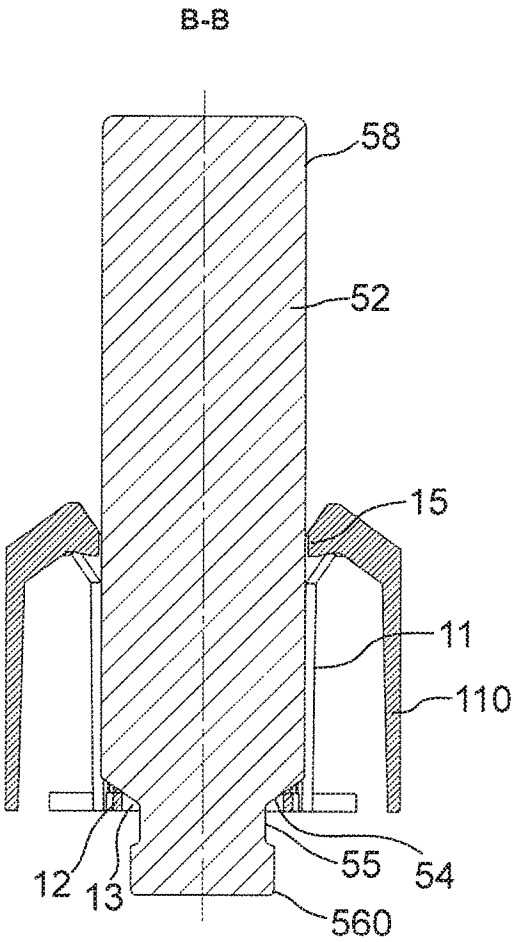
FIG. 5*e* is a partial section along B-B in FIG. 5*c*.
Figure 5D:
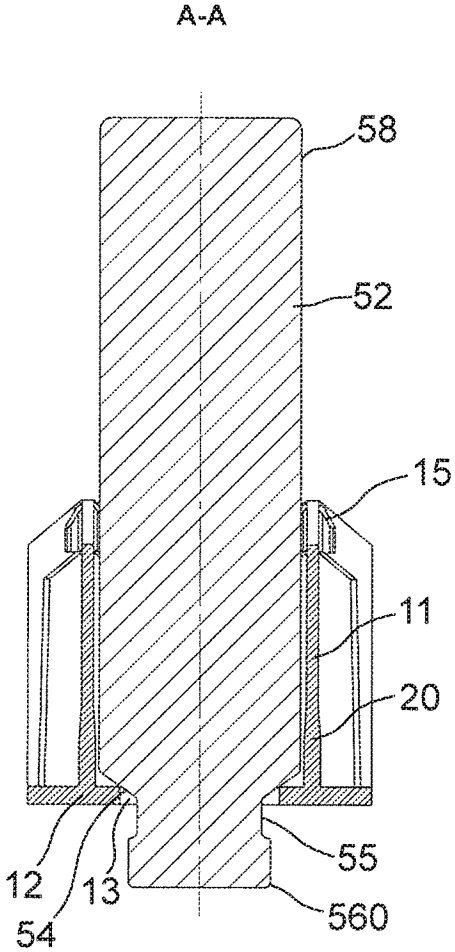
FIG. 5*d* is a partial section along A-A in FIG. 5*c*.

FIG. 5*a* shows a base unit of a modified supporting structure according to the fourth embodiment of the present disclosure in a perspective plan view. This is configured to accommodate a cartridge 58 therein upside down, as shown in FIG. 5*b* and as described above with reference to FIG. 6*a*.

Figure 7B:
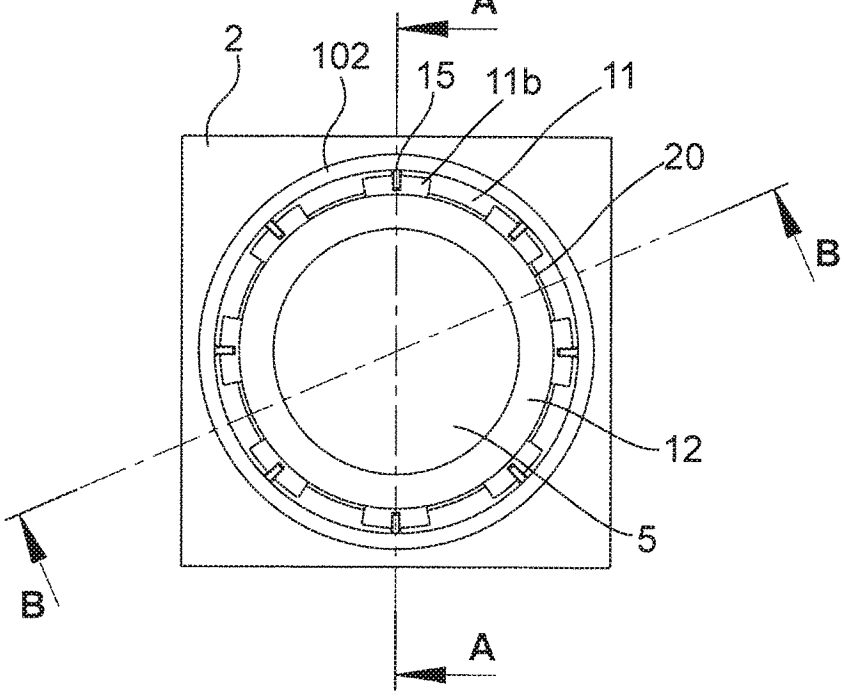
FIGS. 7*a* and 7*b* show a base unit of a modified supporting structure according to a fifth embodiment of the present disclosure in a perspective plan view and in a plan view.
Figure 7A:
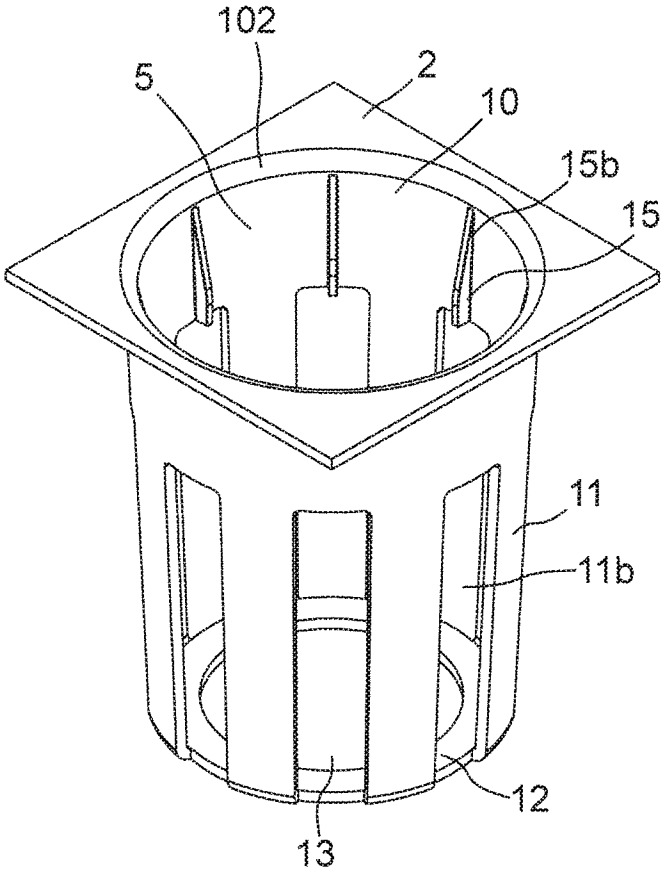

FIGS. 7*a* and 7*b* show a base unit of a modified supporting structure according to a fifth embodiment of the present disclosure in a perspective plan view and in a plan view. In this embodiment, the receptacles 5 are cup-shaped, with axial connecting webs 11 and slots 11*b* formed alternately on the side wall. In extension of the slots 11*b*, upper guiding and positioning lugs 15 are formed on the circumferential peripheral web 10 on the underside of the base plane, at the upper ends of which insertion bevels 15*b* are inclined relative to them. These extend up to the beveled edge 102, which further assists the catching of the containers upon insertion into the receptacles 5. Lower guiding and positioning portions 20 are formed at the lower ends of the axial connecting webs 11. These may protrude from the axial connecting webs 11 radially inwards into the receptacles 5. According to a preferred embodiment, the lower guiding and positioning portions 20 are formed directly by the inner surfaces of the axial connecting webs 11. Thus, there is an angular offset and a functional separation between the upper and lower guiding and positioning portions 15, 20. The slots 11*b* are provided so that the upper guiding and positioning lugs 15 can be trimmed from the lower tool half during injection molding, so that they extend only over a short portion in the longitudinal direction of the receptacles 5. The upper and lower guiding and positioning portions 15, 20 are arranged alternately and angularly offset relative to each other, if viewed in a plan view.

Figure 7D:
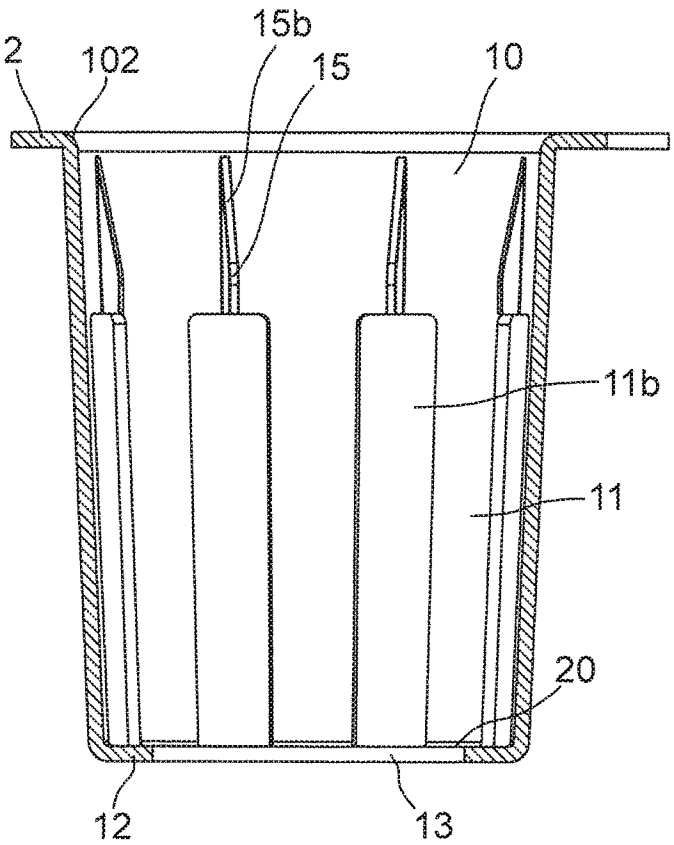
FIGS. 7*c* and 7*d* show the base unit according to FIG. 7*a* in a partial section along A-A in FIG. 7*b* and along B-B in FIG. 7*b*. respectively.
Figure 7C:
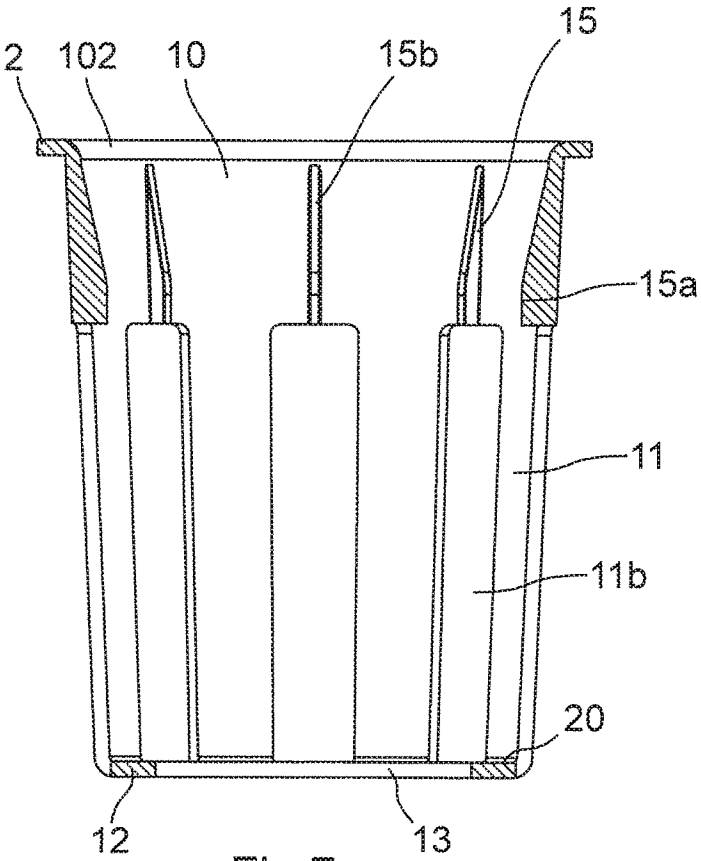
Figure 7F:
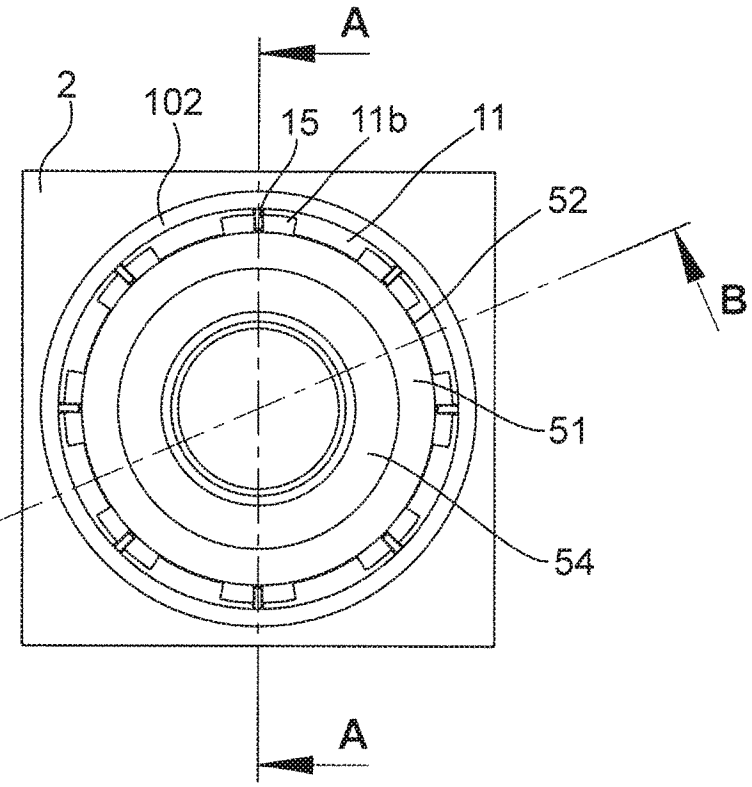
FIGS. 7*e* and 7*f* show the base unit according to FIG. 7*a* with a vial held therein in a perspective plan view and in a plan view.
Figure 7E:
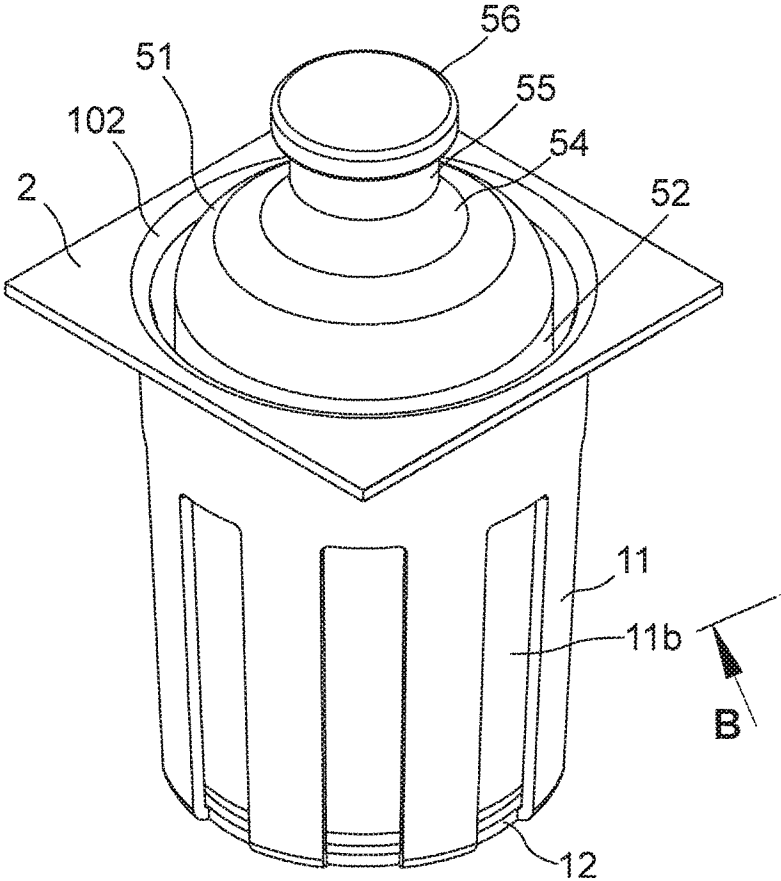
Figure 7H:
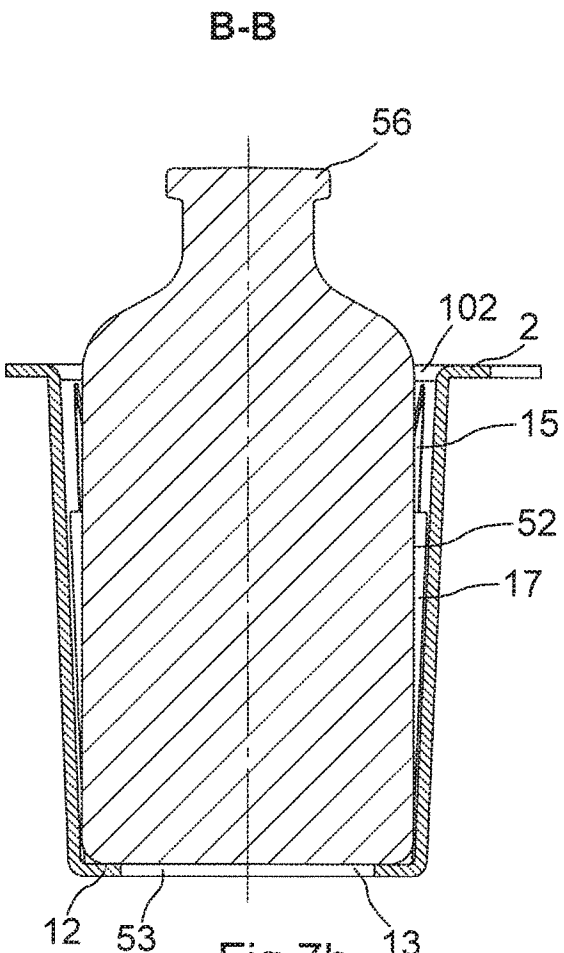
FIGS. 7*g* and 7*h* show the base unit according to FIG. 7*e* in a partial section along A-A in FIG. 7*f* and along B-B in FIG. 7*f*, respectively.
Figure 7G:
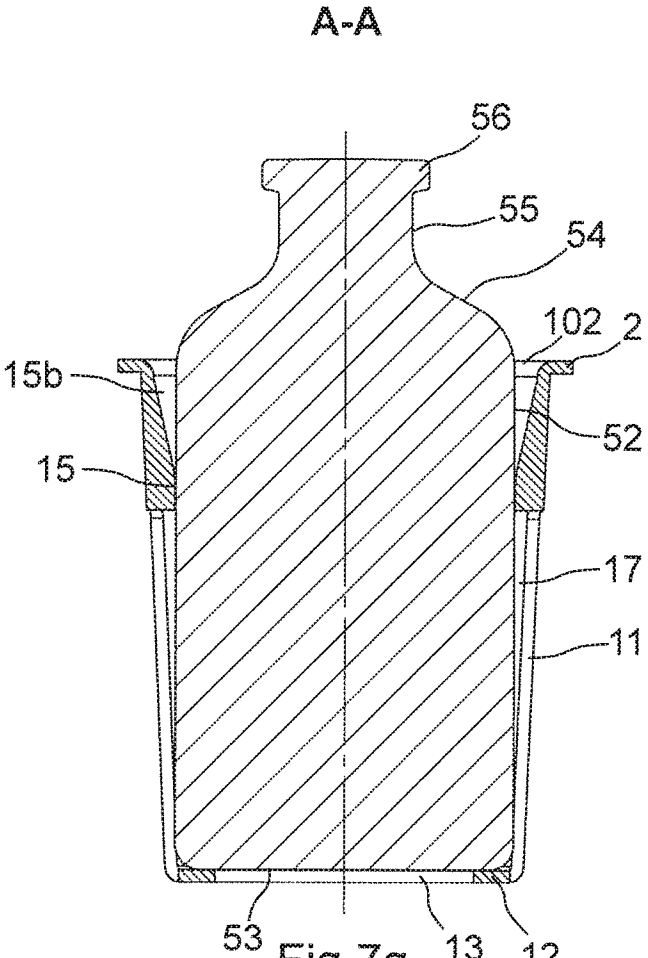

FIGS. 7*c* and 7*d* show the base unit according to FIG. 7*a* in a partial section along A-A in FIG. 7*b* and along B-B in FIG. 7*b*, respectively. FIGS. 7*e* to 7*h* show the accommodation of a vial in such a base unit in different drawings.

Figure 9B:
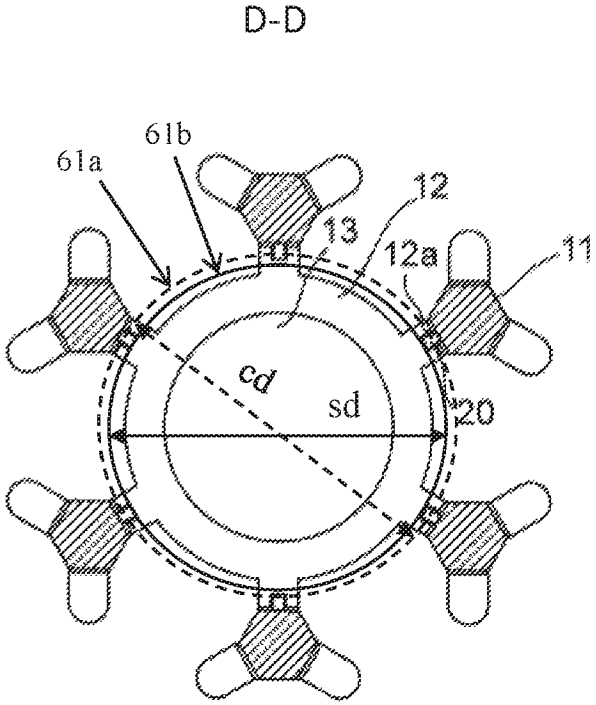
FIGS. 9*a* and 9*b* show a variation of the base unit according to FIG. 2*a* in a longitudinal section along C-C and along D-D according to FIG. 2*a*, respectively.
Figure 9A:
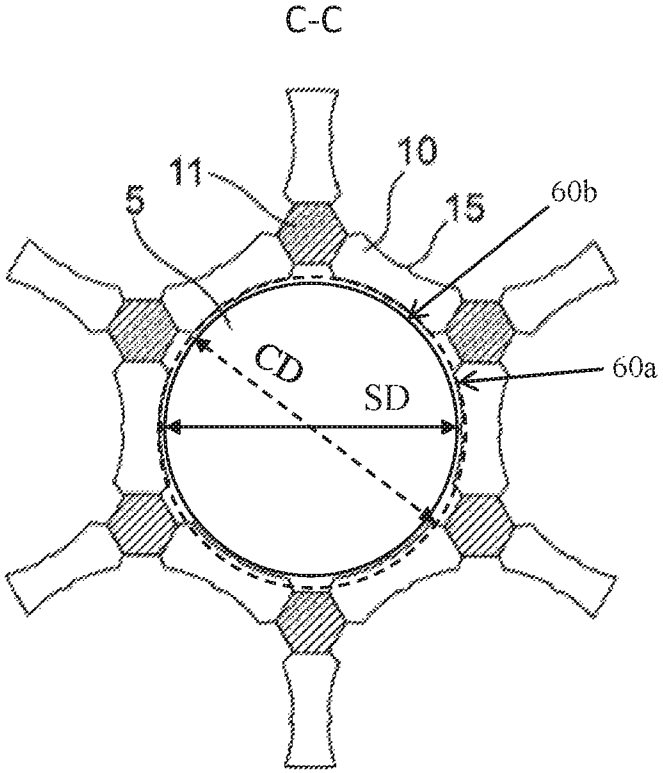

FIGS. 9*a* and 9*b* show another variation of the basic unit according to FIG. 2*a*. The two sectional views according to FIGS. 9*a* and 9*b*, respectively, show the area of an upper and lower guide respectively, which is formed jointly by the upper guiding and positioning portions 15 and lower guiding and positioning portions 20, respectively. Due to the lead-in chamfers formed on the upper and lower guiding and positioning portions 15, 20 respectively, one can assign to each guide a catching circle 60*a* or 61*a* (shown in dashed lines) having a catching diameter CD or cd and a circle 60*b* or 61*b* (shown in solid lines) with a diameter SD or sd. The catching diameter CD corresponds to the diameter of the circle 60*a*, in which a container inserted from above is caught by the upper guide. The catching diameter cd corresponds to the diameter of the circle 61*a* in which a container inserted from above is caught by the lower guide.

Since the guiding and positioning portions 15 and the lower guiding and positioning portions 20 can be formed independently of each other according to the present disclosure, the catching diameter cd of the catching circle 61*a* of the guide formed by the lower guiding and positioning portions 20 may be larger than the smallest diameter SD of the upper guide formed by the upper guiding and positioning portions 15.

Such a configuration would only be possible for a conventionally manufactured injection molded part having upper and lower guiding and positioning portions if the upper and lower guiding and positioning portions are arranged at an angular offset, which is not necessary according to the present disclosure. With one or more upper and lower guiding and positioning portions, which are arranged so as to overlap with each other if viewed in a plan view, the diameter of the guides formed by these guiding and positioning portions can only be reduced monotonously in the case of a conventional injection molded part. Any undercutting would cause problems during demolding.

On the other hand, the present disclosure makes it possible to design the diameter progression of the upper and lower guide independently of each other. Accordingly, the smallest diameter SD of the upper guide can be designed narrower, which would not be possible in the prior art due to the demolding bevel over the full length.

Similarly, the catching diameter cd of the lower guide can also be designed relatively large, which would also not be possible according to the prior art due to the full length of the demolding bevel due to the boundary condition that the diameter can only be reduced downwards.

As a result, a container can be simply inserted into the receptacles according to the present disclosure and is very precisely positioned not only in the area of the lower guide formed by the lower guiding and positioning portions but also in the area of the upper guide formed by the upper guiding and positioning portions.

As can be readily concluded from a comparison of FIGS. 9*a* and 9*b*, the diameter range SD<d<CD of the upper guiding and positioning portions 15, ranging from the diameter SD of the circle 60*b* of smallest diameter enclosed by the upper guiding and positioning portions 15 to the diameter CD of a catching circle 60*a* enclosed by the upper guiding and positioning portions 15, may overlap with the diameter range sd<d<c of the lower guiding and positioning portions 20, ranging from the diameter sd of the circle 61*b* of smallest diameter enclosed by the lower guiding and positioning portions 20 to the diameter cd of a catching circle 61*a* enclosed by the lower guiding and positioning portions 20. This overlap of the two diameter ranges can be about 1 mm and preferably about 2 mm.

As described above in an exemplary manner with reference to FIG. 1*h*, a supporting structure according to the present disclosure together with the containers held on it may be accommodated in a transport or packaging container. In particular, the transport or packaging container may be closed or sealed by means of a gas-permeable plastic film, in particular by means of a plastic film formed from a gas-permeable mesh of plastic fibers and in particular a Tyvek® film.

Figure 8A:
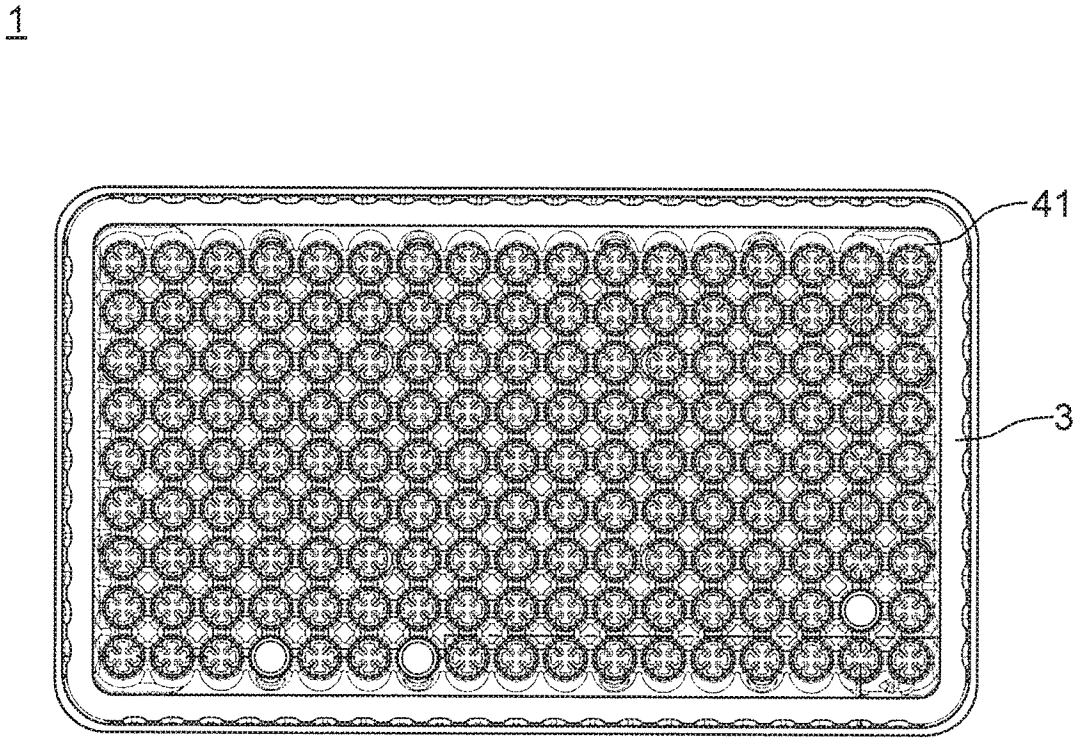
FIG. 8*a* shows a supporting structure according to a further embodiment of the present disclosure in a plan view.
Figure 8B:
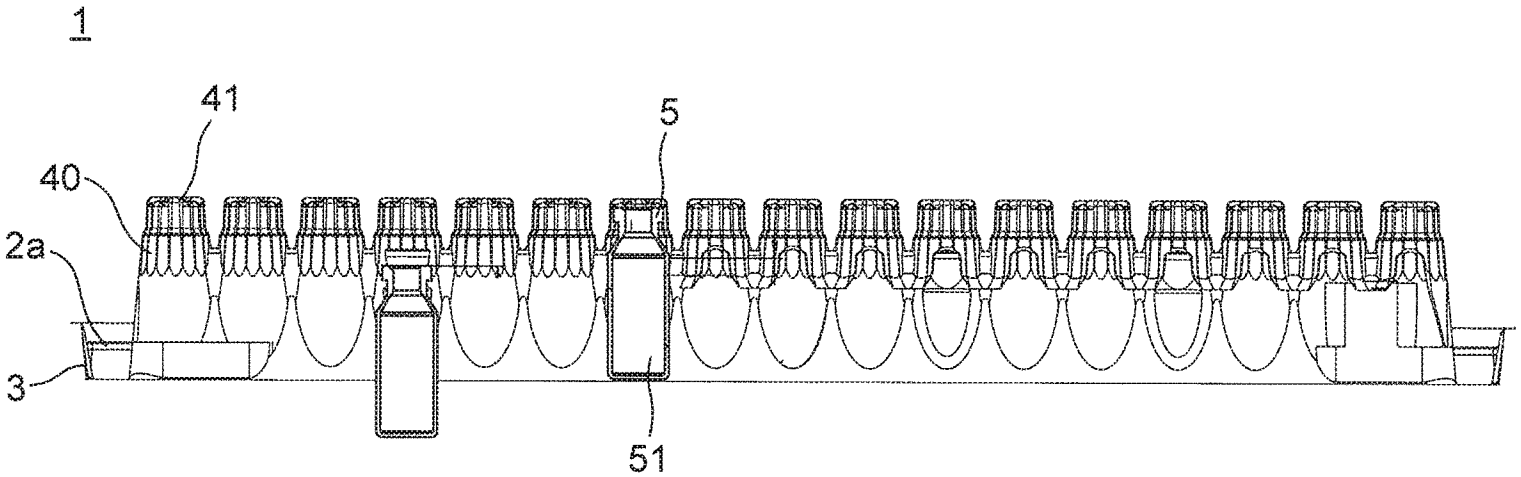
FIG. 8*b* is a partial section along A-A in FIG. 8*a*.
Figure 8C:
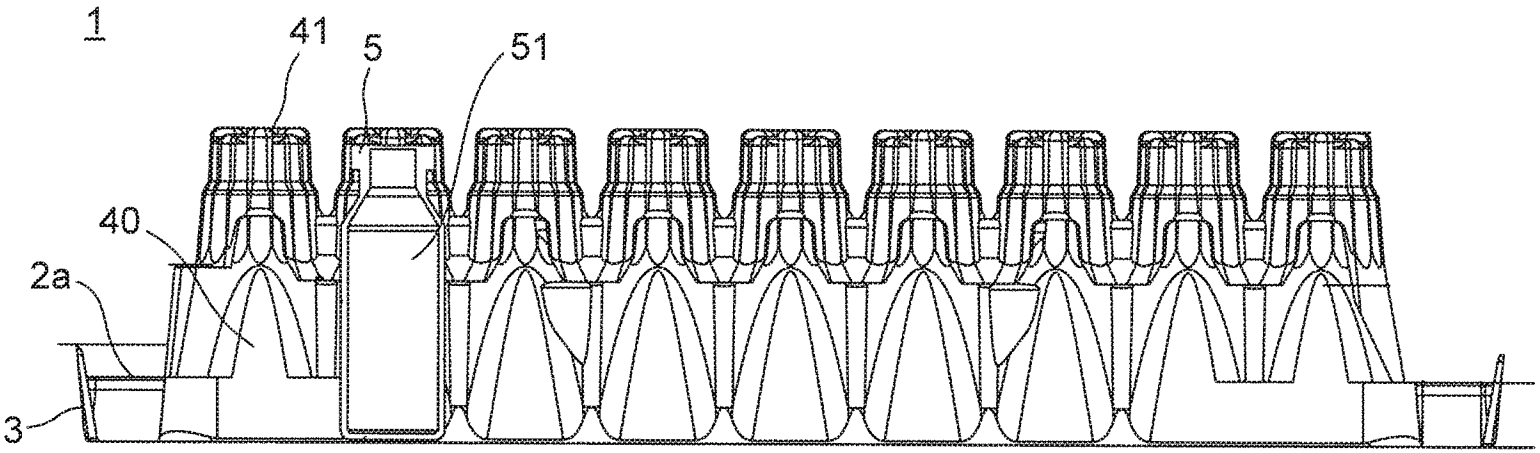
FIG. 8*c* is a partial section along B-B in FIG. 8*a*.

However, a supporting structure according to the present disclosure is basically also suitable for so-called tray solutions, particularly for vials, as shown in FIGS. 8*a* to 8*c* as an example.

According to FIGS. 8*a* to 8*c*, the supporting structure 1 is formed as an accommodating member in which the plurality of receptacles are formed as truncated cone receptacles 5 in a regular arrangement as a single piece. In order to be accommodated, the vials 51 (as an example for a pharmaceutical container) are accommodated in the receptacles 5 of the accommodating member 1 with their upper ends directed towards the bottoms 41 of the receptacles 5 while a direct contact of adjacent vials 51 is prevented. Here, the vials 51 are completely accommodated in the receptacles 5, i.e. they do not protrude beyond the edge of the supporting structure 1. The lengths of the receptacles 5 are preferentially matched to the vials 51 in such a manner that the bottoms of the vials 51 are flush with the edge of the supporting structure 1. The above-mentioned insertion bevels and guiding ribs are formed on the inside of the side walls 40.

In order to form a transport structure, a supporting member may be placed on the accommodating member and be connected to it in such a manner that the bottoms of the vials accommodated in the accommodating member are covered. The supporting member is preferably formed by a base plate having a flat supporting surface facing the receptacles, on which the bottoms of the vials 51 are directly supported.

For such a tray system, the accommodating member and the supporting member generally may be produced of plastic material by injection molding, wherein the insertion bevels and guiding ribs may assist the demolding of the accommodating member in the manner described above.

If a non-sterile transport of the pharmaceutical containers is sufficient, the accommodating member may be formed by connecting it to the supporting member to form a non-sterile transport structure. If a sterile transport of the pharmaceutical containers is desired, the open side of the accommodating member may also be closed by a sealing film, for example by gluing along a flange-like edge of the accommodating member, possibly with additional welding spots to form a sterile transport structure.

For a sterile transport, such a transport or packaging container, together with other similar transport or packaging containers if necessary, may be placed in at least one sterile packaging bag and packed sterile against the environment. The at least one sterile packaging bag may have a gas-permeable portion or may even be made entirely of it, which is formed in particular by a mesh of plastic fibers such as polypropylene fibers (PP).

As will be readily apparent to the skilled person when studying the above description, due to their shape and dimensions the upper and lower guiding and positioning lugs, which act as upper and lower guiding and positioning portions, are essentially to be regarded as rigid, stiff structures which do not deform significantly when the containers are guided. The choice of material also contributes to this effect. The upper and lower guiding and positioning lugs are preferably designed as relatively narrow upper and lower ribs in order to ensure the highest possible packing density of the supporting structure. However, the upper and lower guiding and positioning lugs are not so narrow or short that the upper and lower guiding and positioning lugs deform and buckle themselves when guiding the containers. When guiding the containers, the upper and lower guiding and positioning lugs can be displaced slightly, if necessary, due to the general flexibility of the supporting structure itself, i.e. in particular due to the flexibility of the axial connecting webs and of the lower connecting webs.

Preferred dimensions of the upper and lower guiding and positioning lugs disclosed above are as follows:

the width of a single upper and/or lower guiding and positioning lug conveniently is in the range between 0.5 mm and 5 mm;

the width of a single upper and/or lower guiding and positioning lug is preferably in the range between 1 mm and 2 mm;

the length of a single upper and/or lower guiding and positioning lug conveniently is in the range between 0.5 mm and 20 mm;

the length of a single upper and/or lower guiding and positioning lug is preferably in the range between 5 and 20 mm;

the angular circumference of a single upper and/or lower guiding and positioning lug is conveniently in the range between 1° and 90°;

the angular circumference of a single upper and/or lower guiding and positioning lug is preferably in the range between 5° and 20°.

The above-mentioned dimensions in axial direction of the receptacles refer in particular to commercial lengths of vials, cartridges or syringe bodies for the storage of pharmaceutical drugs.

As explained above, a simple injection molding process is used to produce the one-piece supporting structure, while a simple mold with an upper mold and a lower mold is used, which conveniently does not have additional sliders to create complex undercuts or even double-walled structures on the supporting structure. This may result in certain restrictions regarding the geometry of the supporting structure. In particular, there can be no double-walled structure with a cavity in between in one direction of the supporting structure, for example in the axial direction of the receptacles or of axial connecting webs or transverse to them.

While the present disclosure has been described with reference to one or more particular embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this disclosure.

LIST OF REFERENCE NUMERALS

1 supporting structure
2 upper side or base plane of supporting structure
2*a* bottom
3 upper rim
4 rounded corner region
5 opening or receptacle
6 access opening
10 peripheral web
100 wedge-shaped profile of peripheral web 10
101 vertical edge
102 insertion bevel/side flank of peripheral web 10
103 central section of peripheral web 10
11 axial connecting web
11*a* upper end of axial connecting web 11/point of intersection of peripheral webs 10
11*b* slot between axial connecting webs 11
110 second axial connecting web
12 bottom web
12*a* lower connecting web
12*b* retaining protrusion
13 opening
14 recess
15 upper guiding and positioning lug
15*a* front end of upper guiding lug 15
15*b* insertion bevel
16 guiding surface
17 gap
20 lower guiding and positioning lug
21 insertion bevel
30 protrusion
31 front side wall of protrusion 30
32 side wall in transition region of protrusion 30
35 recess
36 front side wall of recess 35
37 side wall in transition region of recess 35
40 side wall of receptacle 5
41 bottom of receptacle 5
50 outer contour of vial
51 vial/container
52 side wall
53 bottom
54 shoulder portion
55 narrowed neck portion
56 upper rim
560 crimped-on metal lid
57 filling opening

60*a* catching circle, formed by the upper guiding and positioning portions 15

60*b* circle of smallest diameter, formed by the upper guiding and positioning portions 15

61*a* catching circle, formed by the lower guiding and positioning portions 20

61*b* circle of smallest diameter, formed by the lower guiding and positioning portions 20

70 transport and packaging container

71 bottom of transport and packaging container 70

72 lower side wall of transport and packaging container 70

73 step of transport and packaging container 70

74 upper side wall of transport and packaging container 70

75 upper rim of transport and packaging container 70

76 rounded corners of transport and packaging container 70

What is claimed is:

1. A supporting structure, comprising a plurality of receptacles, wherein each of the receptacles comprises an open upper end, a lower end, and a centerline along a longitudinal axis, wherein the lower end comprises a retaining portion that projects radially into the receptacle;

guiding portions, wherein the guiding portions comprise a plurality of upper guiding portions close to the upper ends of the receptacles and a plurality of lower guiding portions close to the lower ends of the receptacles;

a plurality of axial connecting webs associated with each of the plurality of receptacles, wherein each of the axial connecting webs has a portion that is parallel to the centerline; and a plurality of peripheral webs, wherein each of the peripheral webs is associated with one of the plurality of receptacles, wherein the peripheral webs form the upper ends of the associated receptacles, and wherein each of the peripheral webs is connected to the plurality of axial connecting webs associated with the receptacle, wherein the upper guiding portions and the lower guiding portions are not directly connected to each other, wherein the upper and lower guiding portions are one piece with the supporting structure, and wherein the upper and lower guiding portions each project radially inward into the receptacles.

2. The supporting structure as claimed in claim 1, wherein between the plurality of upper guiding portions and the plurality of lower guiding portions in the longitudinal direction of the receptacles is a distance that is larger than the distance between the upper guiding portions and the upper ends of the receptacles and/or larger than the distance between the lower guiding portions and the lower ends of the receptacles.

3. The supporting structure as claimed in claim 1, wherein the plurality of upper guiding portions and the plurality of lower guiding portions are rigid guiding portions.

4. The supporting structure as claimed in claim 1, wherein the upper guiding portions and/or lower guiding portions have front ends that together enclose an upper or lower circle.

5. The supporting structure as claimed in claim 1, wherein the upper guiding portions are arranged at angles offset to the lower guiding portions, if viewed in a plan view, and wherein the upper and lower guiding portions are not overlapping each other.

6. The supporting structure as claimed in claim 5, wherein the lower guiding portions enclose a catching circle that has a diameter that is larger than the diameter of a circle of smallest diameter enclosed by the upper guiding portions.

7. The support structure as claimed in claim 6, wherein the upper guiding portions have a diameter range extending from the diameter of the circle of smallest diameter enclosed by the upper guiding portions to a diameter of a catching circle enclosed by the upper guiding portions, wherein the lower guiding portions have a diameter range extending from a diameter of a circle of smallest diameter enclosed by the lower guiding portions to the diameter of the catching circle enclosed by the lower guiding portions, wherein the diameter range of the upper guiding portions overlaps with the diameter range of the lower guiding portions.

8. The supporting structure as claimed in claim 1, wherein the upper guiding portions and/or the lower guiding portions are each narrow upper and lower ribs, respectively, extending in the longitudinal direction of the receptacles.

9. The supporting structure as claimed in claim 8, wherein the upper and/or lower ribs have front contact surfaces that each have a profile that is wedge-shaped in longitudinal direction or which is rounded off.

10. The supporting structure as claimed in claim 8, wherein the upper and/or lower ribs have front contact surfaces that each extend downward at an acute angle of inclination relative to the longitudinal direction of the receptacles.

11. The supporting structure as claimed in claim 10, wherein the angle of inclination is in the range between 0° and 3°.

12. The supporting structure as claimed in claim 10, wherein the angle of inclination is in the range between 0.0° and 1.5°.

13. The supporting structure as claimed in claim 10, wherein the angle of inclination is in the range between 0.0° and 0.5°.

14. The supporting structure as claimed in claim 8, wherein the upper and/or lower ribs have front contact surfaces that are concavely curved, or wherein front contact surfaces of the upper and/or lower guiding ribs are respectively convexly curved.

15. The supporting structure as claimed in claim 5, wherein the upper guiding portions and/or the lower guiding portions are each ring segments extending in the longitudinal direction of the receptacles.

16. The supporting structure as claimed in claim 8, wherein the upper guiding ribs or the upper guiding portions are each one piece with an associated one of the peripheral webs.

17. The supporting structure as claimed in claim 16, wherein the peripheral webs protrude from an upper side or base plane of the supporting structure, and wherein the peripheral webs are provided with insertion bevels and have a wedge-shaped profile, if viewed in the longitudinal direction of the receptacles.

18. The supporting structure as claimed in claim 16, wherein each of the peripheral webs is higher at intersection regions of adjacent peripheral webs than at central portions between intersection regions.

19. The supporting structure as claimed in claim 18, wherein the axial connecting webs extend downward from the central portions of the peripheral webs, which are connected with the bottom side of the supporting structure.

20. The supporting structure as claimed in claim 16, further comprising retaining portions that are provided the axial connecting webs, which protrude perpendicularly from the upper side or base plane of the supporting structure and which are connected with intersection regions of respective two or of respective three peripheral webs.

21. The supporting structure as claimed in claim 8, wherein the lower guiding ribs are each one piece with the axial connecting webs.

22. The supporting structure as claimed in claim 21, wherein the axial connecting webs have lower ends that form a circumferential side wall, and wherein the lower guiding ribs are each in one piece with the circumferential side wall formed by the lower ends of the axial connecting webs.

23. The supporting structure as claimed in claim 8, further comprising insertion bevels that are respectively at the upper ends of the upper and/or lower guiding ribs, which extend at an angle relative to the associated upper or lower guiding ribs.

24. The supporting structure as claimed in claim 1, wherein the retaining portions are retaining protrusions projecting radially inward, the retaining protrusions enclosing respective openings at the lower ends of the receptacles.

25. The supporting structure as claimed in claim 24, wherein the retaining protrusions are interconnected by bottom webs which enclose the openings at the lower ends of the receptacles.

26. The supporting structure as claimed in claim 1, wherein the supporting structure has an upper side or base plane that is planar at least along the edge of the supporting structure, and wherein the receptacles have lower ends that are connected to each other via webs which together span a plane.

27. The supporting structure as claimed in claim 1, wherein the receptacles are connected with each other by connecting webs, the receptacles being formed in such a manner that two supporting structures of identical configuration can be stacked one on top of the other in such a manner that the receptacles of an upper supporting structure are partially immersed into the receptacles of a supporting structure located underneath and that the connecting webs of an upper supporting structure are supported directly on an upper side or base plane of a supporting structure located underneath.

28. The supporting structure as claimed in claim 1, wherein the supporting structure is formed in one piece by injection molding from a plastic material, and wherein the supporting structure with the upper and lower guiding and portions sections is designed in such a manner that a two-part original mold with a lower mold and an upper mold can be used for production by injection molding from the plastic material.

29. The supporting structure of claim 1, wherein the upper and lower guiding portions each project radially inward toward the receptacles along an entire circumference of the receptacles.

30. The supporting structure of claim 29, wherein the upper guiding portions are evenly spaced around the circumference.

31. The supporting structure of claim 1, wherein the open end of the receptacles has a circumference, and the upper guiding portions are spaced around the circumference.

* * * * *